United States Patent [19]

Feliz

[11] 4,253,256

[45] Mar. 3, 1981

[54] SELF-LOADING DUALISTIC EARTH EXCAVATOR WITH CONNECTING TELESCOPIC CONVEYING AND DUALISTIC DISTRIBUTION MEANS

[76] Inventor: Jack M. Feliz, 2110 Southridge Dr., Palm Springs, Calif. 92262

[21] Appl. No.: 38,808

[22] Filed: May 14, 1979

Related U.S. Application Data

[62] Division of Ser. No. 912,042, Jun. 2, 1978, Pat. No. 4,167,826.

[51] Int. Cl.[3] ..... E02F 5/22; E01C 19/06

[52] U.S. Cl. ..... 37/104; 172/145; 172/784; 172/785; 172/787; 404/102; 404/108; 404/111; 37/4; 37/DIG. 3; 37/DIG. 19; 280/401; 280/411 R; 280/421; 280/422; 280/477; 180/140; 414/489; 414/502; 414/503

[58] Field of Search ..... 37/104, 105, 107, 110, 37/DIG. 13, DIG. 19, DIG. 3, 102, 108, 97, 4; 172/145, 784, 785, 786, 787; 404/102, 103, 108, 111, 101; 171/16; 280/401, 411 R, 421, 422, 477; 180/140; 414/489, 502, 503

[56] References Cited

U.S. PATENT DOCUMENTS

| | | | |
|---|---|---|---|
| 234,851 | 11/1880 | Clark | 37/102 |
| 3,034,410 | 5/1962 | Ross et al. | 404/108 |
| 3,109,353 | 11/1963 | Ulrich | 404/108 |
| 3,199,423 | 8/1965 | Dickey | 404/111 |
| 3,285,147 | 11/1966 | Gruvris | 404/111 X |
| 3,298,117 | 1/1967 | Pelzer et al. | 37/190 |
| 3,304,634 | 2/1967 | Becker | 37/190 |
| 3,797,954 | 3/1974 | Harris | 404/103 X |
| 3,957,000 | 5/1976 | Plasser et al. | 37/104 X |
| 4,094,249 | 6/1978 | Theurer et al. | 37/104 |
| 4,165,617 | 8/1979 | Dick, Jr. | 404/108 X |

FOREIGN PATENT DOCUMENTS

| | | | |
|---|---|---|---|
| 1965141 | 7/1971 | Fed. Rep. of Germany | 404/108 |
| 2314812 | 10/1974 | Fed. Rep. of Germany | 404/108 |

*Primary Examiner*—E. H. Eickholt

*Attorney, Agent, or Firm*—Harris, Kern, Wallen & Tinsley

[57] ABSTRACT

An improved reciprocatory self-loading dual-ended earth excavation vehicle pivotally connected to two or more unmanned self-leveling and self-maneuvering telescopic conveyor vehicles, the latter in turn are pivotally connected to a multi-function dual-ended distribution vehicle capable of conveying, spreading, wetting, impacting and grading the earth fill. The above-mentioned articulated vehicles provide the means to excavate, convey and discharge a virtually continuous flow of earth while traveling in a forward or rearward direction. The excavation and telescopic conveyor vehicles are readily adaptable to surface mining of various minerals including coal and oil shale by simply exchanging the above-mentioned distribution vehicle for a pivotally connected boom conveyer vehicle which provides the means for discharging the ore at a mill site or for the loading of long haul ore carriers.

4 Claims, 40 Drawing Figures

SELF-LOADING DUALISTIC EARTH EXCAVATOR WITH CONNECTING TELESCOPIC CONVEYING AND DUALISTIC DISTRIBUTION MEANS

This is a division of application Ser. No. 912,042, filed June 2, 1978 now U.S. Pat. No. 4,167,826.

PRIOR CLAIM

I hereby claim the priority provided by my Disclosure Document No. 021575, filed Aug. 20, 1973.

BACKGROUND OF INVENTION

This invention relates to the improvement of a self-loading earth excavating, conveying and distribution vehicles, normally associated with cut and fill construction of highways and earth dams, open pit mining and the like.

In known types of individual earth excavation conveying and distribution vehicles, namely conventional bulldozers, scrapers, loaders, earth and water conveying trucks, graders, impactors and rollers, they are, in the main, not entirely satisfactory due to their costly time and motion loss while excavating, loading, transferring the load, waiting, turning around and, foremost, their empty nonrevenue return to the excavation site.

SUMMARY AND OBJECTS OF INVENTION

In summary the chief aim of the present invention is to eliminate the need for the above-mentioned extraneous vehicles, attendant operators and the associated loss of time and motion. The foregoing is achieved by a manned excavation and distribution vehicle, interconnected by two or more unmanned telescopic conveyor vehicles, thereby providing the means to generate a continuous flow of earth from the point of dislodgement by the reciprocatory cutter-heads and thence into the inby conveying means of the excavation vehicle, thence onto the connected intermediate telescopic conveyor vehicles, and thence onto the connected outby conveying means of the distribution vehicle for ultimate spreading, wetting, grading, and impacting the earth fill. The above-mentioned articulated vehicles may travel independently in a forward or rearward direction with ample freedom of movement to maneuver in confined spaces. The distance allocated to the telescopic travel between the excavation and the distribution vehicles is limited only by the quantity of telescopic conveyors used and/or the length of an intermediate stationary conveyor employed between telescopic conveyor vehicles to cope with an exceptionally long conveying operation.

The end product of the above-mentioned vehicles will result in their ability to excavate, convey, and distribute at least twice the volume of earth at one half the cost of conventional operations.

An object of the present invention is to provide an earth excavation vehicle comprising two identical reciprocatory cutterhead assemblies mounted to each end of the vehicle. The earth dislodged by the cutterheads is forced between the adjustable rock screening bars and the bulldozer blade. The earth moving up the outboard sides of the cutterhead assembly is forced into the right and left hand helical conveyors, the latter in turn moves the earth into the center of the vehicle, thence under the roller mounted chain conveyor, thence onto an inclined longitudinal endless belt conveyor. At this point the conveying means for the oppositely mounted cutterhead assembly is identical as previously mentioned. The earth from either of the forward or rearward inclined conveyors discharges onto a pair of transverse belt conveyors driven in opposite directions in order to divide the load for the purpose of circumventing the rear inclined conveyor. The earth is then discharged onto a pair of longitudinal belt conveyors, thence onto a pair of transverse belt conveyors driven in the same direction, in order to complete the above-mentioned circumvention, thence onto the pivotally mounted telescopic conveyor means for terminal distribution. The above arrangement provides the means to continuously excavate and convey the earth while traveling in a forward or rearward direction. An operator's cab is pivotally mounted to a boom section, the former in turn is provided with a reciprocating hammer and a manipulative hook, for the purpose of fracturing or ejecting oversize rocks from the path of the vehicle. The above-mentioned boom section is pivotally mounted to a swing crane in turn mounted to a traveling bridge crane, the latter in turn is mounted to suitable tracks secured to the top of the vehicle. The above arrangement provides self-crane service and permits the operator to travel from one end of the vehicle to the other, thereby permitting an unrestricted view of both cutterhead assemblies and any other direction in which the vehicle may be driven. The excavation vehicle is provided with a conventional main endless tractor belt propulsion means and is further provided with an auxiliary drive wheel propulsion means, the latter in turn are steerable through an arc of 360 degrees, the drive wheels are further provided with a jack means, capable of elevating the main endless tractor belts and the cutterhead assemblies above ground engagement, for the purposes of highway travel and/or to maneuver laterally or in any other direction desired. The lateral movement facilitates realignment of the vehicle when moving from a completed excavation cut to a new cut, maneuvering around obstacles, etc.

In certain excavation operations, viz., open pit mining, etc., where highway travel and lateral maneuvering is not required, the auxiliary wheel propulsion means may be omitted. Conversely, the tractor drive means may be omitted for operations more suitable for the auxiliary wheel propulsion means. A provision has been made to pivotally rotate the cutterhead assembly frame in order to adjust the depth of the cutting plane in relation to the bottom surface of the endless tractor belts.

Another object of the present invention is to provide an endless belt telescopic conveyor vehicle capable of being towed by other vehicles and/or maneuvered laterally or in any other direction by a self-contained drive and steering means. The telescopic conveyors are coupled together by a universal tow bar comprising a horizontal pivotal means to compensate for telescopic travel, terrain undulations and the stacking of the conveyors for highway travel. A vertical pivotal means permits longitudinal angular alignment between the conveyor vehicles and also between the connecting excavation and distribution vehicles. A transverse pivotal means automatically levels the conveyors as the conveyor wheels travel over transversely inclined terrain or to compensate for the inclination of the adjoining angular positioned conveyor. The universal tow bar is rotatively borne by a swivel plate secured by rollers to the conical hopper car, the latter in turn is secured by roller means to the side channel bars of the adjoining conveyor vehicle, thereby permitting the hopper car to advance rectilinearly along the conveyor channel bar tracks, thus creating a telescopic means between connecting conveyors, and thereby permitting the earth to cascade from the superimposed conveyor onto the connecting conveyor without interruption of flow. A telescopic electrical and water conduit means provides continuity between the articulated telescopic conveyor sections. The foregoing arrangement provides the means to insure a continuous flow of earth, electricity and water, regardless of the angular and telescopic positions assumed between the conveyor vehicles and the excavation and distribution vehicles.

Another object of the present invention is to provide a multi-function dualistic distribution vehicle, comprising a universal tow bar to receive a telescopic conveyor. The tow bar is rotatively secured to a swivel plate, the latter in turn is rotatively borne by a conical hopper in turn secured to the frame of the vehicle. The earth cascades from the conveyor thence through an aperture in the swivel plate thence onto a pair of oppositely driven transverse conveyors thence onto a pair of longitudinal conveyors, the latter are retractable thus permitting the earth to be discharged on either side of a double faced grader blade, a pair of water sprinkling pipes discharge on each side of the grader blades. A pair of rear impactor wheels are chain driven through a differential and motor drive. A pair of forward impactor wheels support a steering fork and column, the latter in turn supports the forward end of the distribution vehicle. A pair of bulldozer blades are pivotally mounted on each end of the vehicle to disperse earth windrows, created by each pass of the grader blades.

The foregoing functions are arranged to process the continuous flow of the earth fill while the distribution vehicle travels in a forward or rearward direction.

Still another object of the present invention is a modification to the first embodiment of the earth excavation vehicle, comprising an identical reciprocatory cutterhead driving mechanism, pivotally mounted to the side draw bars of the excavation vehicle, a means to raise or lower the cutterhead assembly in relation to the endless tractor belts, a bulldozer blade pivotally mounted to the cutterhead assembly frame with a means to raise of lower the dozer blade in relation to the top surface of the cutterhead assembly thereby providing a means to select a bulldozing function with the blade in a lowered position or raising the blade to provide a front end loading function. The height of the blade controls the volume of earth flowing into the conveying means. A rock screening means controls the size of the rock permitted to enter the conveying system. An ejecting device is traversely mounted to the dozer blade, for the purposes of ejecting oversize rocks and unwanted debris from the path of the dozer blade. A pair of reciprocatory conveyors discharge the earth onto a pair of longitudinal endless belt converyors pivotally mounted at one end to the cutterhead assembly frame and the other end is slidably engaged to the excavation vehicle, thence discharging onto a pair of transverse conveyors, thence discharging the earth onto the pivotally mounted telescopic conveying means for terminal distribution. The installation of an identical cutterhead assembly mounted on the opposite end of the above-mentioned vehicle is feasible, thus converting the above vehicle into a dual-ended earth excavator, in a like manner indicated in the following modification of a dual-ended earth excavator.

Another object of the present invention is a second modification to the first embodiment of the earth excavation vehicle, comprising a scraper scoop pivotally mounted to each end of the tractor vehicle, a means to raise of lower the scraper assembly in relation to the lower ground engaging surface of the endless tractor belts. The fragmented earth particles are forced up the inclined scraper face by the forward motion of the vehicle, thence onto two inclined longitudinal endless belt conveyors . One end of the conveyor is pivotally mounted to the scraper and the other end is slidably engaged to a pair of endless belt transverse conveyors driven in the same direction. At this point the conveying means for the oppositely mounted scraper scoop is identical as previously mentioned. The earth then cascades onto a longitudinal belt conveyor thence onto the pivotally mounted telescopic conveyor vehicle for terminal distribution. An operator's cab is pivotally mounted to a boom section and in turn is pivotally mounted to a bell crank, the latter in turn is pivotally mounted to the vehicle frame. A reciprocating hammer is pivotally mounted to the cab. The above arrangement permits the operator to swing his cab to either end of the vehicle for an unobstructed view of each scraper and to place the hammer in position for ejecting or fracturing large sheets of oil shale or other earth fragments too large to enter the conveying system. A rock screening means mentioned before may be installed in the scraper scoop if desired.

The foregoing arrangement permits a continuous scraping operation while the scraper vehicles travels in a forward or rearward direction, thus virtually generating a constant flow of earth to the terminal distribution.

Still another object of the present invention is a modification to the first embodiment of the distribution vehicle, comprising an identical structure with the following exceptions: the two transverse conveyors, the two outboard longitudinal conveyors and the dual-faced grader blade have been omitted. The principal modification is the center positioned reversible endless belt conveyor secured to the top of the vehicle and extends beyond the dozer blades. The double apertured hopper is secured to the conveyor frame, thus permitting the earth to be discharged from either side of the hopper in accordance with the travel direction of the belt. The earth cascades off either end of the conveyor and passes between a pair of sprinkler pipes mounted to the conveyor, thence landing in front of the previously mentioned dozer blades; thus by reversing the belt direction to coincide with the vehicle direction, the conveying, wetting, spreading and impacting of the earth fill is achieved while the modified vehicle travels in a forward or rearward direction. The omission of the grader blade and the use of the dozer blades for spreading the earth in front of the impactor wheels will suffice for certain earth fill operations where precise grading is not required.

A further object of the present invention is to provide another modification to the distribution vehicle comprising an endless belt boom conveyor pivotally mounted to a bracketed turret, the latter in turn is rotatively borne on the rear platform of the vehicle. Means are provided to elevate, depress and train the boom. A fixed conical hopper is secured to the inby end of the boom conveyor. The previously mentioned telescopic conveyors are pivotally connected to the fixed hopper in an identical manner previously described for the first embodiment of the distribution vehicle. The above arrangement provides a maneuverable vehicle capable of stockpiling the ore adjacent to or remote from the excavation site and/or loading long haul carriers, viz., trucks or railroad gondola cars at open pit mines, etc. Still another object of the above distribution vehicle is to tow one or more stacked telescopic conveyors on the highway.

Another object of the present invention is to provide the before-mentioned excavation vehicles with modified scraper blades in lieu of the reciprocatory cutterhead assemblies. The use of the scraper blades would be more economical for certain types of earth excavation operations entailing the scraping and gathering into the conveying system, blasted rock fragments and other loosely packed earth particles encountered in natural form.

The foregoing objects, advantages, features and results of the present invention, together with various other objects, advantages, features and results thereof which will be evident to those skilled in the art to which the invention relates in the light of this disclosure, may be achieved with the exemplary embodiments of the invention illustrated in the accompanying drawings and described in detail hereafter.

DESCRIPTION OF DRAWINGS

In the drawings:

FIG. 23 is an enlarged vertical cross section taken as indicated along the angled arrows XXVIII—XXVIII of FIG. 25, illustrating the hinged reciprocatory conveyor shovel blade.

DESCRIPTION OF EXEMPLARY EMBODIMENTS OF THE INVENTION

Dualistic Excavation Vehicle

Figure 1:
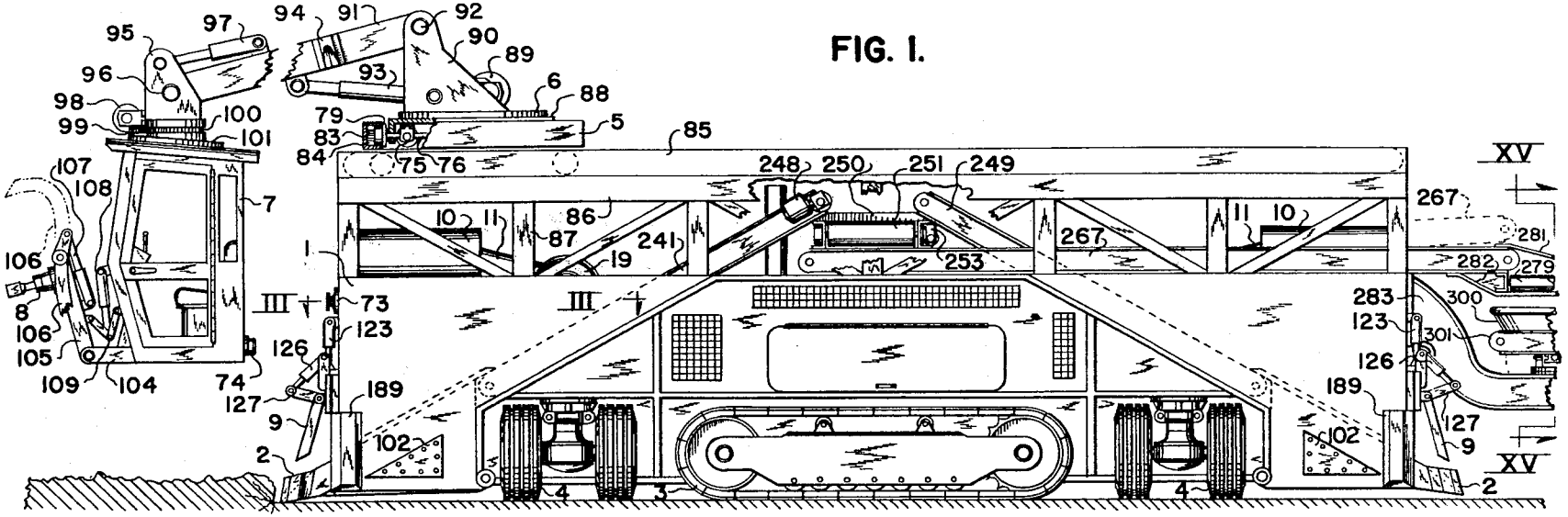
FIGS. 1, 1*a* and 1*b*, taken together constitute a side elevational view of the dualistic earth excavation vehicle, operating in conjunction with the pivotally connected telescopic conveyor vehicles and in turn, pivotally connected to the dualistic distribution vehicle.
Figure 2:
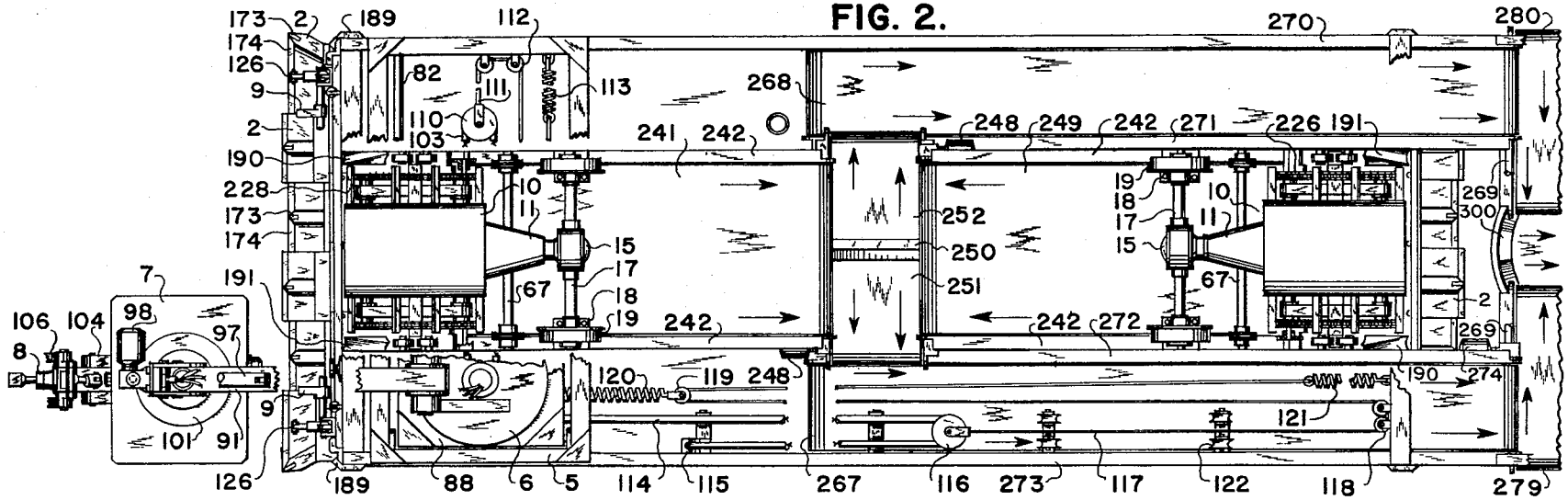
FIGS. 2, 2*a* and 2*b* taken together constitute a plan view of the excavating, conveying and distributing vehicles shown in FIGS. 1, 1*a* and 1*b*.

Referring to FIGS. 1 and 2 of the drawings, the present invention generally comprises a vehicle 1 provided with a pair of reciprecatory cutterhead assemblies 2 mounted at each end; a pair of main endless tractor belts 3; four pairs of auxiliary drive wheels 4; a bridge crane 5; a swing crane 6; a rotatable operator's cab 7; a rock fracturing and ejecting mechanism 8; and a rock screening device 9. The vehicle's dualistic conveying means will be described later in detail.

Auxiliary Wheel Drive, Steering and Jack Assembly

Figure 3:
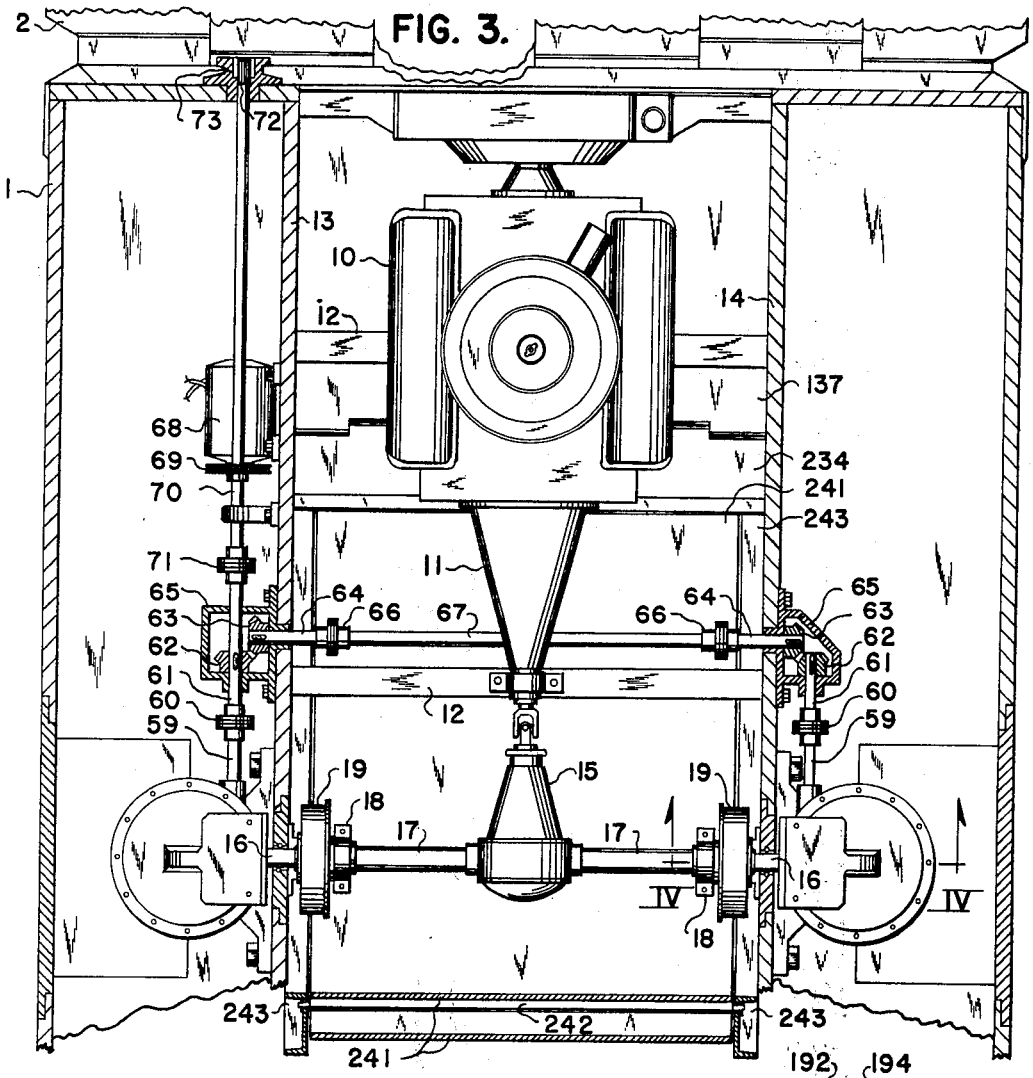
FIG. 3 is a horizontal section taken as indicated along the angled arrows III—III of FIG. 1, illustrating the propulsion and steering power trains of the forward auxiliary drive wheel assembly.

Referring to FIG. 3, the auxiliary wheel drive motor 10 and the transmission 11 are supported by transverse brackets 12 to the inboard sides of the wing walls 13 and 14, the transmission 11 drives the differential 15, the latter in turn drives the transverse drive shafts 16. The drive shaft housings 17 are supported by brackets 18 in turn are secured to the wingwalls 13 and 14.

Figure 5:
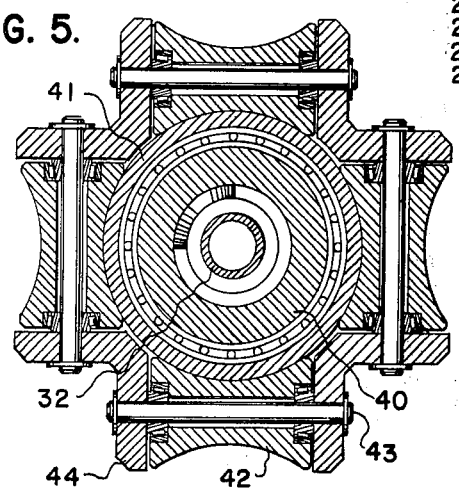
FIG. 5 is a horizontal cross sectional view taken as indicated along the angled arrows V—V of FIG. 4, illustrating details of the auxiliary wheel drive lateral thrust rollers, thrust sleeve, lower piston skirt and drive shaft.
Figure 4:
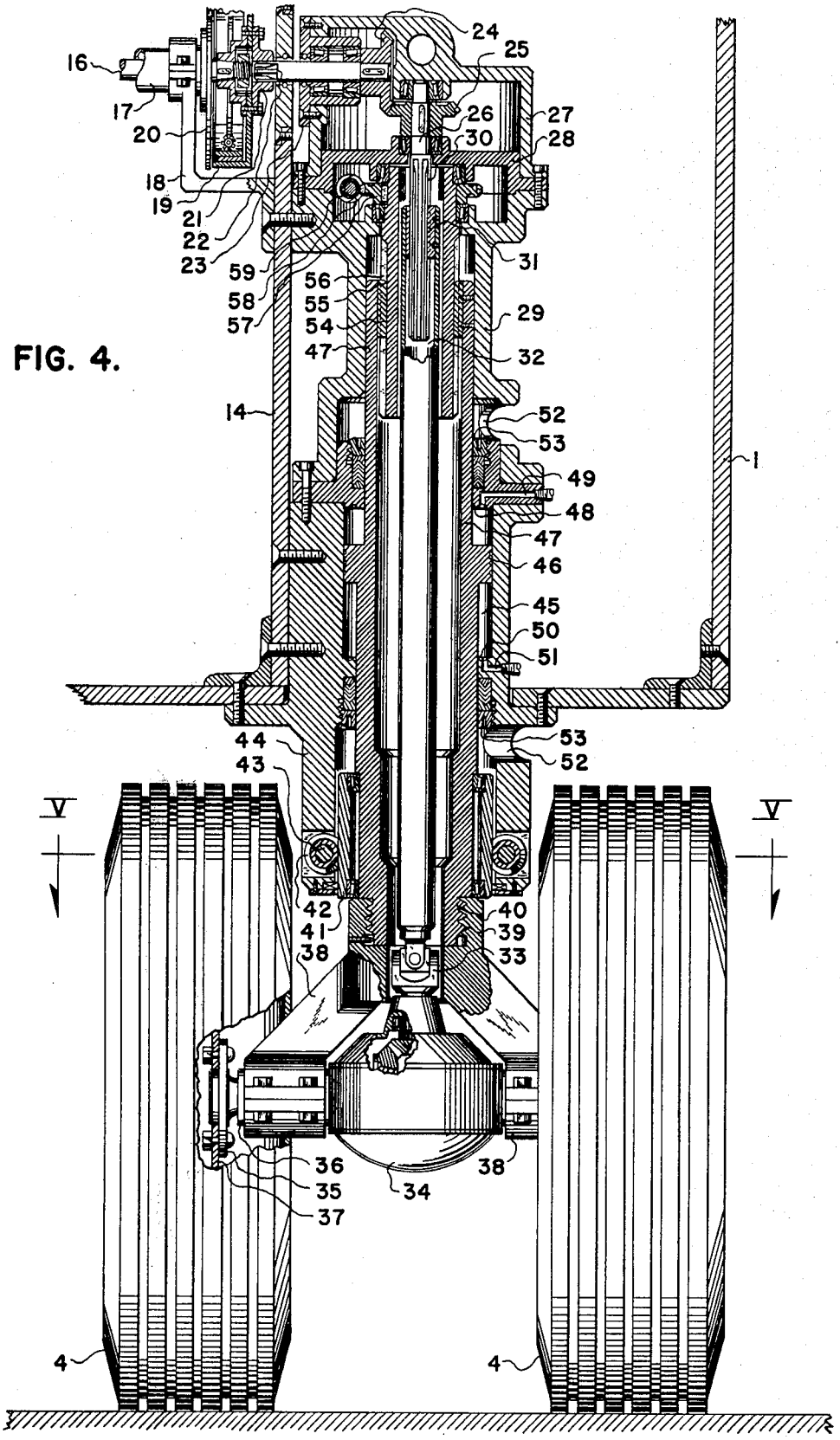
FIG. 4 is an enlarged vertical section taken as indicated along the angled arrows IV—IV of FIG. 3, illustrating details of the auxiliary wheel drive, steering and jack mechanisms.
Figure 6:
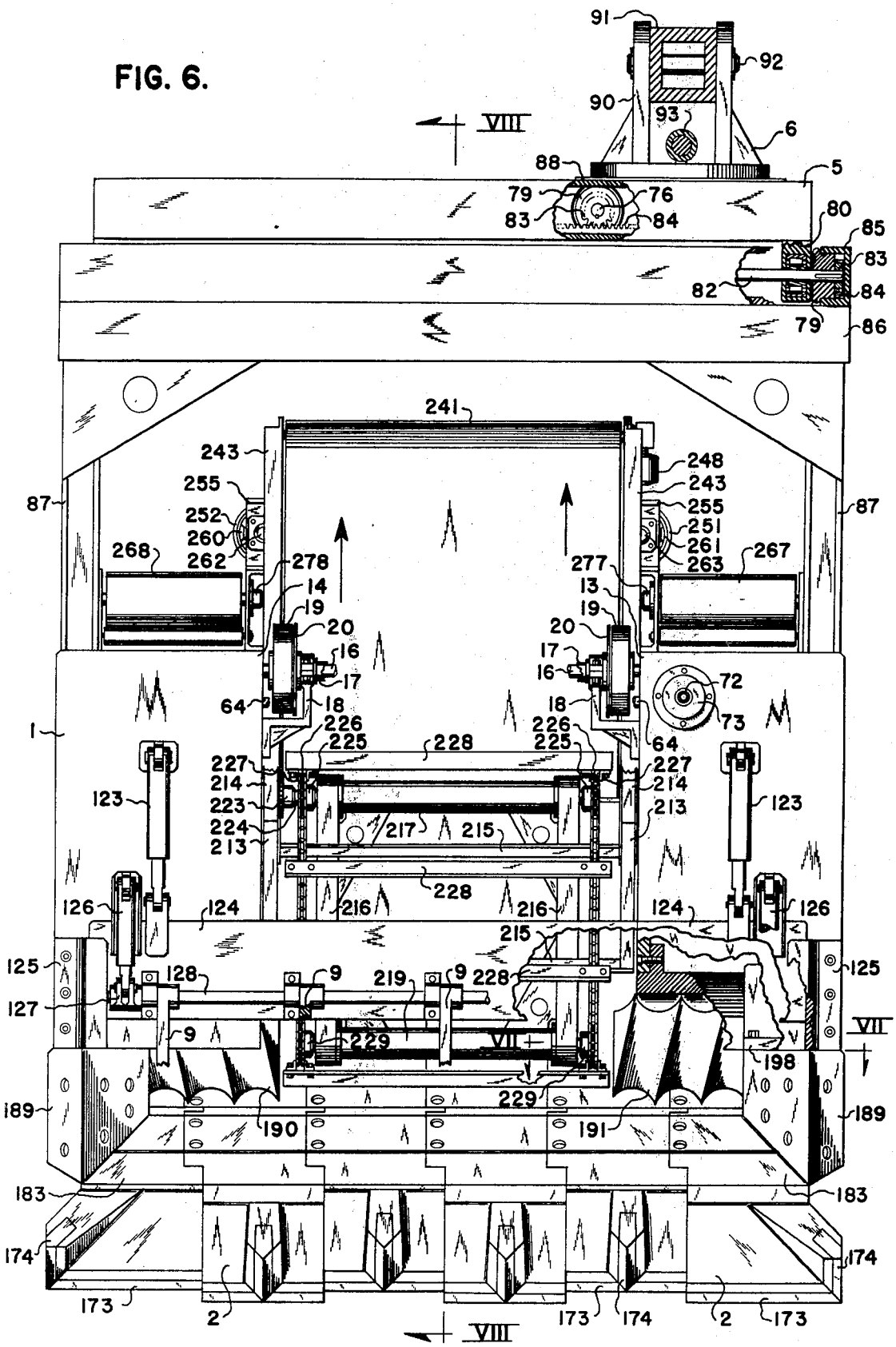
FIG. 6 is an end elevation of the dualistic earth excavator.
Figure 8:
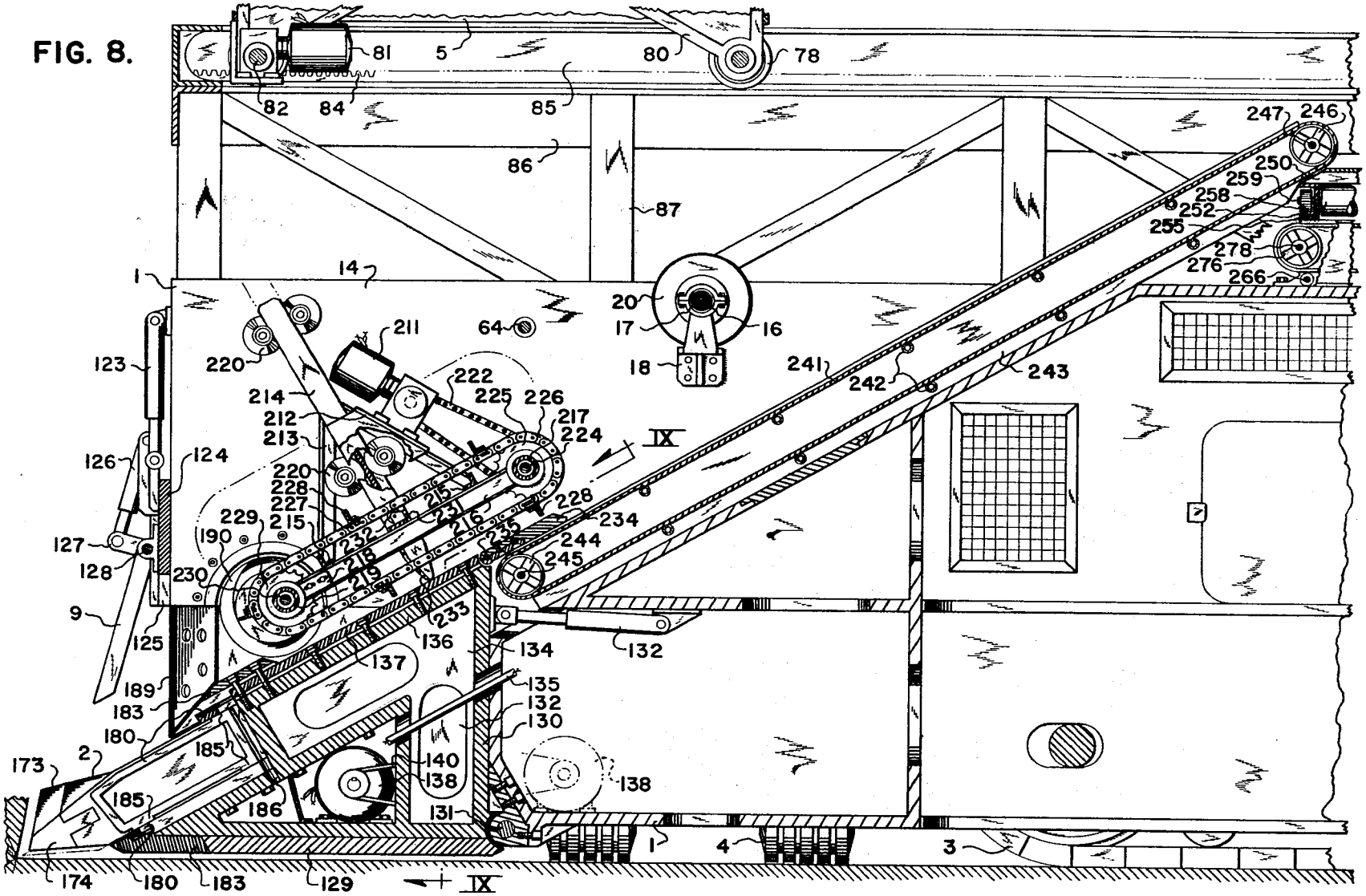
FIG. 8 is a vertical section taken as indicated along the angled arrows VIII—VIII of FIG. 6, illustrating details of the cutterhead assembly, the chain conveyor, the belt conveyors and the rock screening means.
Figure 12:
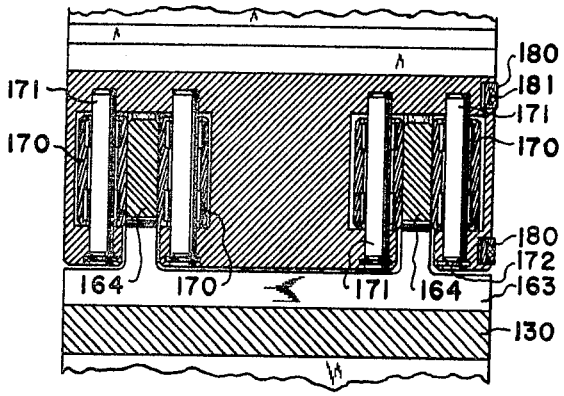
FIG. 12 is an enlarged vertical section taken as indicated along the angled arrows XII—XII of FIG. 11, illustrating details of the cutterhead lateral thrust rollers and the extended vertical thrust brackets.
Figure 14:
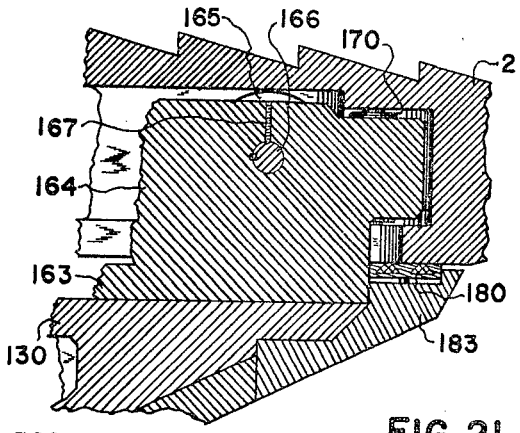
FIG. 14 is a vertical section taken as indicated along the angled arrows XIV—XIV of FIG. 13, illustrating a portion of the transmission block platform and integral upstanding bracket, a portion of the vertical and lateral thrust rollers and the cutterhead.

Referring to FIGS. 6 and 8 and more specifically to FIG. 4, a pair of rotating brake drums 19 are keyed to the outboard ends of the drive shafts 16, the brake backing plate 20 is secured to the shaft housing 17. A coupling 21 is splined to the stub shaft 22 the latter in turn is suitably journaled in bearings supported by the flanged cover 23. Keyed to shaft 22 is a bevel pinion 24 meshing with the driving a bevel gear 25 having its hub keyed to a vertical shaft 26, the latter in turn is suitably journaled in bearings supported by the upper and lower gear covers 27 and 28 respectively, the latter in turn are secured to the upper pedestal housing 29 in turn secured to the wing wall 14. The lower portion of shaft 26 is splined at 30 within a tubular portion 31 of a coaxial drive shaft 32. The drive shaft 32 freely extends or retracts on shaft 26. The lower portion of shaft 32 is connected by the universal joint 33 to the conventional differential 34, the latter is provided with shortened conventional drive shafts 35 and suitably journaled in bearings supported by the shaft housing 36. The shaft 35 is secured to the wheel rim 37, the latter in turn drives the wheels 4. The shaft housing 36 supports the bracket 38 in turn the upper portion is threadly engaged at 39 to the lower piston skirt 40, the latter in turn is suitably journaled in bearings supported by the thrust sleeve 41, the latter is supported by four lateral thrust rollers 42 in turn suitably journaled in bearings supported by shafts 43 in turn supported by the lower pedestal housing 44 (see also FIG. 5). The housing 44 is secured to the wing wall 14. The foregoing arrangement provides a 360 degree lateral thrust means for any direction in which the drive wheels may be oriented and also facilitates the extension and retraction of the lower piston skirt 40 as hereinafter described. The jack means for the vehicle comprises an extensible jack device including a vertical cylinder 45 containing a reciprocable piston 46 having its upper piston skirt 47 extending upwardly through the top cylinder head 48, the latter is provided with a fluid conducting passage 49 with which a liquid supply communicates. The lower piston skirt 40 extends downwardly through the lower cylinder head 50, the latter in turn is provided with a fluid conducting passage 51 with which a liquid supply conduit communicates, as hereinafter described, and when liquid under pressure is supplied to the lower end of the cylinder bore, the piston 46 may be moved upwardly to retract the drive wheels, thus lowering the vehicle with attached cutterheads 2 and tractor belts 3. Conversely when liquid under pressure is supplied to the upper cylinder bore through the fluid passage 49, the piston 46 may be moved downwardly until the drive wheels are in ground engagement thus continuing to apply fluid pressure, the vehicle 1 cutterheads 2 and tractor belts 3 may be raised above ground engagement for highway travel, lateral travel or travel in any other direction desired by the auxiliary drive wheel means. The upper and lower pedestal housings 29 and 44 are provided with access hand holes 52 to facilitate tightening the spanner wrench driven packing gland ring nuts 53. The upper portion of the piston skirt 47 has a splined sleeve 54 secured therein, the latter in turn is slidingly engaged at 55 with the splined tubular steering shaft 56, the latter in turn is suitably journaled in bearings supported by the upper pedestal housing 29 and the gear cover 28. The tubular steering shaft 56 has a worm gear 57 keyed thereto, the latter in turn is driven by the worm 58 in turn is keyed to the horizontal steering shaft 59 in turn suitably journaled in bearings supported by the pedestal housing 29 and the gear cover 28. The foregoing arrangement permits the piston skirt 47 to extend or retract with the jack means while simultaneously providing a steering means to direction orient the drive wheels 4 in a 360 degree arc and further, simultaneously transmitting propulsion power to the drive wheels 4. Referring back to FIG. 3, the remainder of the steering drive assembly will be described hereinafter, the previously mentioned horizontal steering shaft 59 is driven by flexible coupling 60 in turn driven by shaft 61 in turn having keyed thereto a bevel gear 62, meaning with bevel gear 63 in turn having its hub keyed to the shaft 64. The shaft 61 and 64 are suitably journaled in bearings supported by the gear housing 65. A pair of flexible couplings 66 are connected by the transverse shaft 67 thereby connecting the steering means of both forward drive wheel assemblies. The power and hand steering sources are communicated to the beforementioned steering means as hereinafter described, the motor 68 drives suitable sprockets and chain 69 in turn drives the shaft 70 the latter is connected to the flexible coupling 71 the latter in turn transmits steering power to the previously mentioned steering mechanism. A hand steering means is provided by the splined forward portion 72 of shaft 70 suitably journaled in bearings supported on the forward end of the shaft by coupling 73. The engaging coupling 74 is provided on the rear center of the operator's cab 7 (see FIG. 1) a tubular shaft (not shown) is splined to engage the splined portion 72 of shaft 70 thus transmitting hand steering power from suitable hand driven means located in the operator's cab 7 for use in the event of electrical power failure while traveling on a highway. An identical steering means as mentioned above is provided for both of the rear drive wheel assemblies.

Bridge Crane Assembly

As best seen in FIGS. 1, 2, 6 and 8 the crane 5 serves a twofold purpose in that it provides crane service and a supporting platform for the operator's cab 7 which permits the operator to place his cab in a position of unrestricted visibility regardless of the direction in which the vehicle may be traveling. The crane 5 is (see FIGS. 6 and 8) supported by the rear idler wheels 78 and the forward driven wheels 79. The wheels 78 and 79 are suitably journaled in bearings supported by brackets 80 the latter in turn support the crane frame 5. The crane drive motor 81 drives the transverse shaft 82. Keyed to the outboard ends of shaft 82 are the wheels 79 and spur gears 83 meshing with the gear rack 84 the latter in turn is secured to the longitudinal channel bars 85 in turn supported by angle bars 86 the latter in turn are supported by vertical I beams 87 in turn secured to the frame of vehicle 1. The above arrangement provides a positive drive means for the bridge crane regardless of the inclined position of vehicle 1.

Swing Crane Assembly

The swing crane trolley 88 is supported (see FIGS. 1 and 6) and driven in an identical manner previously described for the bridge crane 5. The motor 75 drives shaft 76 in turn drives the supporting wheels 79 and the spur gear 83 meshing with gear rack 84. The above arrangement provides a positive transverse drive for the swing crane trolley regardless of the inclined position of vehicle 1. The swing crane 6 is pivotally mounted to the trolley 88 and rotatably driven by motor 89. The crane 6 has secured to its platform a pair of upstanding brackets 90 in turn supports the pivotally mounted boom 91 on shaft 92. A linear actuator 93 elevates or depresses the boom 91. Secured to boom 91 is a hook 94 for supporting the rigging used to lift out the individual cutterhead assemblies and other repairs to the vehicle 1. A pair of vertical brackets 95 are pivotally mounted at 96 to the distal end of the boom 91. The operator's cab 7 is pivotally mounted to the brackets 95 the latter in turn are elevated or depressed by the linear actuator 97 to maintain a level cab 7 regardless of the angle assumed by the boom 91. Secured to the lower end of the brackets 95 is a ratiomotor 98 in turn drives a spur pinion 99 meshing with and driving the spur gear 100 the latter in turn is secured to a bushing 101 in turn secured to the roof structure of cab 7. The above arrangement will pivot the cab 7 in a 360 degree arc. The rock fracturing and ejecting mechanism 8 comprises a pair of brackets 104 secured to the cab 7 frame.

The brackets 104 in turn support the pivotally mounted boom 105 the latter in turn has secured thereon a reciprocating rock fracturing hammer 8. The distal end of the boom 105 pivotally mounts a pair of claws 106 for ejecting rocks or unwanted debris. A linear actuator 107 will extend or contract the claws 106. The linear actuator 108 is pivotally connected to the toggle device 109 in turn is pivotally connected to the boom 105 and the cab 7. The retraction of the actuator 108 will depress the hammer 8 and the claws 106 from the travel position to a working position.

Referring to FIG. 2 the electric control and power cables 103 pass from the cab 7 up through the center of gear 100 thence through boom 91, thence down through the center of the swing crane 6 thence turns at a right angle and is then reeved through the takeup pulley 110 thence secured to a junction box (not shown) secured to crane 5. The pulley 110 is supported by a wire cable 111 thence reeved through a pair of pulleys 112 thence through a spring supported pulley (not shown) secured to the left side of the crane 5 thence reeved back and secured to spring 113 in turn secured to the right side of crane 5. The above arrangement pays out and retracts the cable as the trolley 88 travels transversely. An identical arrangement is provided to pay out and retract the electric cable 114 between the bridge crane junction box and the terminal point of entry 115 into the vehicle 1. The electric cable 114 is reeved through pulley 116 the latter is secured to the wire cable 117 thence reeved through a pair of pulleys 118 the latter are secured to the vehicle 1. The wire cable 117 is then reeved through a pulley 119 the latter in turn is secured to a spring 120 in turn secured to the vehicle 1. The wire cable 117 is then secured to spring 121 the latter is secured to the vehicle 1. The cable 114 is also provided with supporting rollers 122 to prevent the cable 114 from twisting or sagging onto the path of the conveyed earth. The triangular plates 102 secured to the sides of the vehicle 1 provide access to the cutterhead motor compartment.

Rock Screening and Earth Flow Control Assembly

Referring now to FIGS. 6 and 8 the rock screening and earth flow control assembly comprises a pair of linear actuators 123 pivotally mounted at one end to the vehicle 1, the other ends are pivotally mounted to a combination bulldozer blade and earth flow control gate 124. The blade 124 is slidably engaged within a pair of guides 125, the latter in turn are secured to the vehicle 1. A pair of linear actuators 126 are pivotally mounted at one end to the blade 124, the other ends are pivotally mounted to a bell crank 127, the latter having its hub keyed to the horizontal shaft 129 the latter in turn are suitably journaled in bearings supported by the blade 124. Keyed also to the shaft 128 are the rock screening bars 9. The above arrangement controls the size of the rock fragments and the volume of earth permitted to enter the conveyor system.

Cutterhead Assembly

The cutterhead assembly is best seen in FIG. 1, 2, 6, 8–14, 24, 25. Referring now in particular to FIG. 8 illustrating the supporting frame structure 130 pivotally mounted at 131 to the vehicle 1. A wearing plate 129 is secured to the bottom of frame 130. The extension of the linear actuator 132 will depress the cutterhead frame 130 and the attached cutterheads 2. The above pivotal arrangement is illustrated for an excavation vehicle using solely the tractor belt 3 propulsion means and voiding the before-mentioned height adjusting auxiliary drive wheels, conversely if it is desired to have an excavation vehicle equipped with only the auxiliary drive wheels then the frame 130 would be a fixed structure secured to the vehicle 1. The jack means of the drive wheels would elevate or depress the cutterheads 2 in relation to the ground engaging surface of the wheels 4.

The frame 130 comprises multiple compartments (see also FIG. 9) to house the independent cutterhead transmission blocks 132. The above-mentioned compartments are separated by double spaced walls 133 and 134 in effect creating small compartments between each block compartment to provide for a heat venting means and an electrical or hydraulic conduit 135 passageway. The conduit access holes are located in the rear of the frame 130 and the rear end of the motor compartment. The tops of the double walls are provided with longitudinally disposed "T" bars 136 for bolting the overlapping threshold plates 137 thereto. The sectionalized plates 137 facilitate removal of an independent transmission block 132 to effect repairs.

Figure 24:
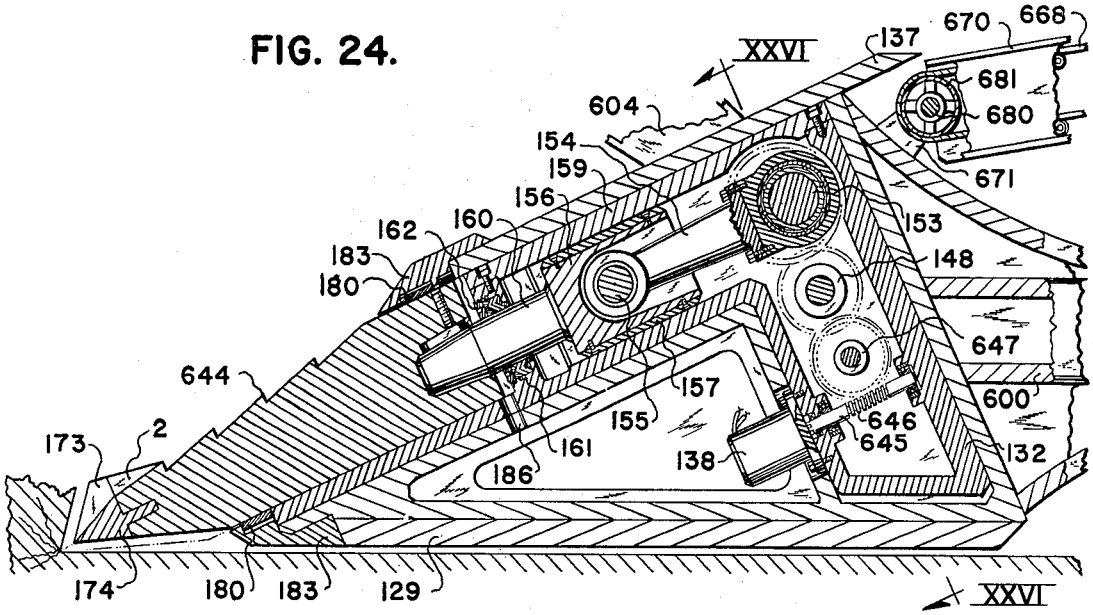
FIG. 24 is an enlarged vertical section taken as indicated along the angled arrows XXIV—XXIV of FIG. 23, illustrating details of the cutterhead drive mechanism and the supporting frame assembly.

The lightening holes are provided in the double walls and other suitable locations to reduce the weight of the frame structure 130. The cutterhead drive mechanism comprises one or more motors 138 secured to frame 130. The preferred location of motors 138 is in the compartment above the shaft 131 for the fixed version of the cutterhead frame 130. A belt pulley 139 is secured to the motor 138 thence driving belt 140 in turn driving pulley 141 the latter is keyed to the line shaft 142, the latter in turn is connected by flexible couplings 143. The shaft sections 142 are suitably journaled in bearings secured to the frame 130. The spur pinion gears 144 are keyed to the shaft 142 in the center of each transmission block compartment. The spur gear 144 meshes with and drives the spur gear 145 having its hub keyed to the horizontal shaft 146, the latter in turn is suitably journaled in bearings supported by the transmission block 132. The above arrangement permits the removal of the independent block 132 without disassembly of the line shaft 142 and spur pinions 144, the above arrangement also permits the timing of the independent cutterhead gear trains in order that the cutterheads may strike the earth in a suitably timed sequence. Keyed to the shaft 146 is the spur gear 147 meshing with and driving the spur gear 148 having its hub keyed to the shaft 149 the latter in turn is suitably journaled in bearings supported by the block 132. The spur gear 148 meshes with and drives spur gear 150 having its hub keyed to the shaft 151 the latter in turn is suitably journaled in bearings supported by the block 132. Keyed to the opposite end of the shaft 151 is a split rim and hub flywheel 152. Formed at the center of the shaft 151 is an eccentric 153 in turn drives the connecting rod 154 the latter is suitably journaled on bearings supported by shaft 151 (see FIG. 10). The eccentric 153 and the connecting rod 154 convert the rotary motion to a reciprocatory motion. The distal end of the connecting rod 154 is pivotally mounted to the shaft 155 the latter in turn is pivotally mounted to the crosshead block 156 the latter is supported on the four side surfaces by the low friction slipper plates 157 secured as by screws 158. The plates 157 are adjustable by the insertion of shims between the crosshead 156 and the plates 157 to compensate for wear. The plates 157 are slidingly engaged with the inner surface bearing guides of the block 132. The under surface of the cover plate 159 (see FIGS. 9, 10, 26) is the upper guide to the top slipper plate 157 thereby forming a crosshead guide box. The crosshead 156 is provided with an integral cutterhead drive shaft 160 that extends forwardly through the front end wall 161 of the block 132. The end wall 161 is provided with an adjustable packing gland 162 to form an oil seal between the shaft 160 and the crosshead box. The distal end of the shaft 160 is provided with a taper to engage a tapered socket in the cutterhead 2, the latter is keyed to the shaft 160 and locked on by a set screw as shown in FIG. 24. The removal of the cutterhead from the shaft 160 is accomplished by removing the above-mentioned set screw and inserting jack bolts or a hydraulic puller (not shown) between the cutterhead 2 and the end wall 161. The cutterhead may be removed for repairs without disassembling the transmission block.

A novel cutterhead thrust means is provided by extending from the transmission block 132 an integral platform 163 with upstanding integral guide brackets 164 (see also FIGS. 11–14). The platform 163 is secured to the frame 130 as by screws 164.

The cutterhead is also novel in structure in that a vertical and lateral thrust means is provided within the cutterhead at a point where the maximum thrust is generated, while cutting the earth. The cutterhead 2 vertical thrust means comprises eight rollers 165 suitably journaled on bearings the latter in turn are supported by the horizontal shafts 166 the latter in turn are keyed to the brackets 164. The shafts 136 are locked in position by set screws 167. The cutterhead 2 is provided with a pair of vertically disposed "T" shaped slots and are arranged longitudinally and in parallelism with the shaft 160. The upper surface 168 and the lower surface 169 of the "T" slots provide roller paths for the rollers 165. The above arrangement provides an eightpoint vertical thrust support for the reciprocatory cutterheads 2, regardless of whether the cutterhead is thrusted upward or downward. The lateral thrust means comprises four vertically disposed thrust rollers 170 suitably journaled on bearings supported by the vertically disposed shafts 171, (see FIGS. 10–12) the shafts 171 are secured to the cutterhead 2 as by lock rings 172. The lower ends of the shafts 171 are provided with threaded extraction holes. The rollers 165 and 170 are contained within the hollows of the same "T" slots. The rollers 170 laterally thrust against the previously mentioned upstanding brackets 164. The above arrangement provides a two-point lateral thrust support for the cutterhead 2, regardless of whether the cutterhead is thrusted laterally to the right or to the left side. The horizontal and the vertical leading edges 173 and 174 respectfully (see FIGS. 6, 8) of the cutterheads 2 are provided with cemented tungsten carbide inserts or other suitable hard faced material. The combination of the horizontal and the vertical carbide inserts provide right angled cutting surfaces to sever, fragment and dislodge the earth into particle sizes small enough to pass through the screening bars and the subsequent conveying system to be described later in detail. The outboard cutterhead faces are offset sufficiently to cut a path in the earth wide enough to provide adequate clearance for the cutterhead frame 130 and the vehicle 1.

The cutterhead dirt seals are provided to prevent the earth particles from entering the thrust roller assembly and building up between the block end wall 161 and the rear end of the cutterhead 2, thereby preventing premature repairs and an unwanted disconnection of the cutterhead 2 from the crosshead shaft 160. The dirt seals are best seen in FIGS. 8, 10–14, the seals are comprised of high content graphite cast iron plates 180 and highly impregnated graphite bronze inserts 181 or other suitable material. The seal plates 180 are provided with integral stub shafts 182 the latter are slidingly engaged within the seal retainer plates 103 (see FIG. 13). The helical springs 184 are positioned in the counterbored inner face of the retainer plates 183 and encircle the stub shafts 182. The above arrangement provides a spring urged compression on the seal plates 180 and the adjacent cutterhead surfaces at all times regardless of the longitudinal reciprocating, lateral or vertical movement of the cutterheads. The upper seal retainer plates 183 are secured to the threshold plates 137. The lower retainer plates 183 are secured to the frame structure 130, the side plates 183 are secured to the vehicle 1 as by screws. The upper retainer plates 183 are provided with an additional row of seals in order to better cope with the bulk of the dislodged earth and the resultant force generated by the advancing vehicle. Dirt seals are provided between each cutterhead and differ from the abovementioned seals only in their configuration. (See FIGS. 8, 10, 13). One side of each cutterhead 2 is provided with suitable recesses to receive the seal plate 180. The intercutterhead seal plates 180 are provided with lands 185 to slidingly engage the upper and lower seal plates 180 and the block platform 163. The upper and lower seal plates 180 and the seal retainer plates 183 have their end joints half-lapped in order to minimize the entrance of the earth particles (See FIG. 3). In spite of the efficient earth scaling means as mentioned above, minute earth particles may pass the seal barriers, thus to prevent an accumulation of earth from occurring, the drain holes 186 (FIGS. 8, 11) have been provided to permit the earth particles to be forced by the reciprocating action of the cutterhead into the lower enclosed compartment adjacent to the motor compartment for subsequent removal. It will be noted in the drawings that there are two different external configurations for the inboard cutterheads 2, the type previously mentioned and noted in FIGS. 1, 2, 6 and 8 are more suitable to severing and fracturing oil shale and coal deposits into particle sizes small enough to pass through the rock screening device 9. The other cutterhead design noted in FIGS. 10, 11, 14, 22–25, is more suitable to general earth excavations.

Excavator Vehicle Conveyor Assemblies

The self-loading and the conveying of the dislodged earth through the excavator vehicle is best seen in FIGS. 1, 2, 6, 7, and 8. Referring more particularly to FIG. 8, the reciprocating movement of the cutterheads 2, sever, fracture and dislodge the earth in combination with the forward or rearward travel of the excavation vehicle 1, thereby forcing the dislodged earth up the enclined cutterheads 2 thence over the upper seal retainer plates 183 and simultaneously the earth dislodged by the outboard cutterheads 2 is forced inboard by the vertical diversion plates 189 into the path of the left and right hand horizontal helical conveyors 190 and 191 respectively, the latter in turn convey the earth from the outboard cutterheads toward the longitudinal center line of the vehicle 1 and into the main stream of earth flowing between the wing walls 13 and 14.

Helical Conveyor Assembly

Figure 7:
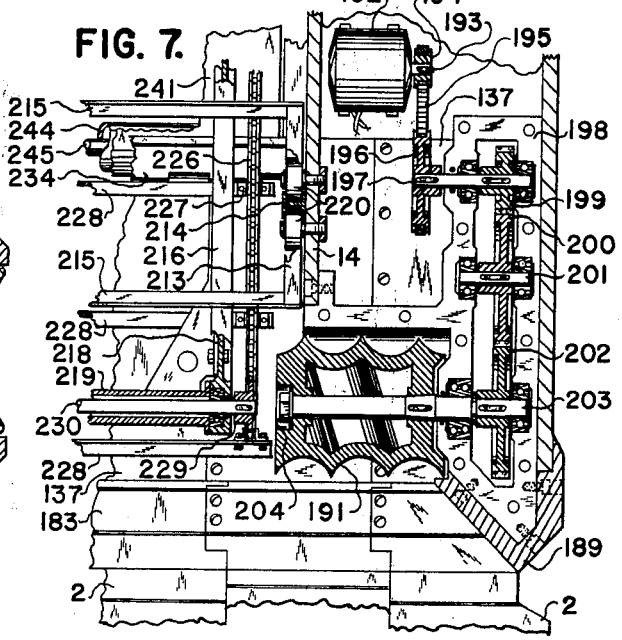
FIG. 7 is a horizontally inclined section, taken as indicated along the angled arrows VII—VII of FIG. 6, illustrating details of the helical conveyor, the chain conveyor and the rock screening means.

Referring now to FIG. 7 the helical conveyor mechanism comprises a motor 192, having its power shaft 193 horizontally disposed and keyed to the latter is a drive pulley 194 in turn driving belt 195 in turn driving pulley 196 the latter in turn having its hub keyed to the horizontal shaft 197 the latter is suitably journaled in bearings supported by the transmission case 198 the latter is secured to the threshold plates 137. Keyed to the outboard end of shaft 197 is a spur pinion 199 meshing with and driving the spur gear 200 having its hub keyed to the shaft 201 the latter is suitably journaled in bearings supported by the case 198. The spur gear 200 meshes with and drives spur gear 202 the latter having its hub keyed to the horizontal shaft 203 the latter is suitably journaled in bearings supported by the case 198. The helical conveyor drum 191 has its hub keyed to the shaft 203 and secured thereto by the nut 204. The drive mechanism for the helical conveyor 190 is identical to the foregoing, the only exception is the direction in which the conveyor drums 190 and 191 rotate (see FIG. 6). The drum 190 is provided with a right hand helix thus facing the distal end of the drum 190 and looking outboard the drum will rotate clockwise thereby moving the earth toward the center line of the vehicle 1. The drum 191 is provided with a left hand helix, thus facing the distal end of the drum 191 and looking outboard the drum will rotate counterclockwise thereby moving the earth toward the center line of the vehicle 1. The earth conveyed by the helical conveyors and the inboard cutterheads flow into the path of the inclined chain conveyor described hereinafter.

Chain Conveyor Assembly

Referring to FIGS. 2, 6, 7, and more particularly FIG. 8, the chain conveyor comprises a Ratiomotor 211 secured to the base plate 212 the latter in turn is secured to the angle bars 213 the latter in turn are secured at the upper end to the N bars 214. The lower end of the angle bars 213 are secured to the transverse angle bars 215 the latter in turn are secured to the inclined longitudinal I bars 216 in turn are secured at one end to the upper conveyor shaft housing 217. The lower end of I bar 216 is provided with a take-up bracket 218 the latter in turn is secured to the lower conveyor shaft housing 219, the former provides an adjusting means for the conveyor chains 226. The H bars 214 are slidingly engaged with four pairs of rollers 220 and 221 the latter are secured to the wing walls 13 and 14 (See also FIG. 7). The above arrangement permits the chain conveyor and the supporting frame structure to raise and fall with the varying heights of the conveyed rocks and earth particles. The ratiomotor 211 is provided with a chain driver sprocket (not shown) the latter in turn drives the chain 222 in turn drives the sprocket 223 (See FIG. 6) having its hub keyed to the horizontal transverse shaft 224 the latter in turn is suitably journaled in bearings supported in the shaft housing 217. A pair of sprockets 225 are keyed to shaft 224 and mounted outboard of the longitudinal "I" bars 216. The sprockets 225 drive the conveyor chains 226, the latter are provided with link attachments 227 in turn have transverse angle bar lugs 228 bolted thereto. The chains 226 drive the idler sprockets 229 (See also FIG. 7), the latter in turn have their hubs keyed to the idler shaft 230. Referring to FIG. 8 the lower end of the H bars 214 have a transverse bar 231 secured thereto. The bar 231 is also secured to the longitudinal I bars 216. The bar 231 is provided with the chain supporting rollers 232. The lower portion of the bar 214 has the inboard side and the web cut away to prevent the conveyed earth from lodging against the former. The remaining lower outboard side of the H bar 214 is rounded off at 233 to facilitate raising the chain conveyor assembly when adjusting the cutterhead assembly to alter the depth of the cutterhead 2 penetration into the earth's surface as previously mentioned. A bridge plate 234 is hinged at 235 to the threshold plates 137 thereby permitting the adjustment of the previously mentioned cutterhead assembly without disrupting the flow of earth as the chain conveyor simultaneously conveys the earth over the threshold plates 137 and the bridge plate 234 onto the inclined longitudinal belt conveyor as described hereinafter.

Belt Conveyor Assemblies

Referring to FIGS. 1, 2, 6 and more particularly to FIG. 8, the inclined longitudinal endless belt conveyors 241 are centrally positioned between the wing walls 13 and 14. The belt 241 is supported by the rollers 242 the latter in turn are supported by the side channel bars 243, the latter in turn are supported by the vehicle 1. The lower driven belt pulley 244 is keyed to the horizontal transverse idler shaft 245 the latter in turn is suitably journaled in bearings supported by the take-up frames (not shown) the latter in turn are secured to the side channel bars 243. The upper drive belt pulley 246 is keyed to the horizontal transverse drive shaft 247 the latter is suitably journaled in bearings supported by the side channel bars 243. The shaft 247 is coupled to and driven by the ratiomotor 248 (See FIGS. 1 and 2). The rear inclined longitudinal belt conveyor 249 is identical to the forward inclined belt conveyor 241 previously described. The conveyed earth cascades from the upper end of the conveyor 241 when the vehicle 1 is excavating in a forward direction and conversely the earth cascades from the upper end of the conveyor 249 when the vehicle 1 is excavating in a rearward direction. The cascading earth from the conveyors 241 and 249 flows onto the divisional angle bar 250 and the oppositely driven endless belt conveyors 251 and 252 (See also FIGS. 6 and 8). The conveyor 251 is driven by the ratiomotor 253 the latter is connected to a horizontally disposed belt pulley shaft 254 suitably journaled in bearings supported by the side channel bars 255 and 256. The forward end of the shaft 254 has keyed thereon a spur gear 257 meshing with and driving a spur gear 258 (FIG. 8) the latter in turn is keyed to the horizontally disposed drive shaft 259 the latter in turn is suitably journaled in bearings supported by the side channel bars 255 and 256. The idler belt pulleys 260 and 261 (FIG. 6) are supported by shafts 262 and 263 respectively the latter are suitably journaled in bearings supported by the side channel bars 255 and 256. The above arrangement permits the earth cascading from the conveyors 241 and 249 to be divided and conveyed in opposite directions in order to circumvent the rear inclined conveyor 249. The earth then cascades from the above-mentioned conveyors 251 and 252 (See FIG. 2) onto a pair of longitudinally disposed endless belt conveyors 267 and 268 the latter are driven by the connecting transverse shaft 269 suitably journaled in bearings supported by the side channel bars 270, 271, 272 and 273. The ratiomotor 274 drives the before-mentioned shaft 269, the conveyor belt pulleys and the conveyor belts 267 and 268. The Idler belt pulleys 275 and 276 are supported by shafts 277 and 278, the latter are suitably journaled in bearings supported by the side channel bars 270–274 in turn are pivotally mounted at 266 (See FIG. 8) to vehicle 1. The above arrangement permits the distal end of the conveyors 267 and 268 to be elevated by the inby hopper during steep inclines of the vehicle 1 to be described later.

The earth cascades from the conveyors 267 and 268 onto the rear transverse endless belt conveyors 279 and 280 the latter are independently driven toward the longitudinal center line of vehicle 1. The drive motors are not shown. The conveyors 279 and 280 side channel bars are secured to the distal ends of the conveyors 267 and 268 by brackets 281 and 282. (See FIG. 1)

A pair of "S" curved towing brackets 283 are secured to the wing walls 13 and 14. The brackets 283 have a swivel bearing block 284 secured to their apex (See FIG. 15). The earth cascades from the transverse conveyors 279 and 280 into an inby hopper 300 and onto an endless conveyor belt 301 of the telescopic conveyor means as will be described hereinafter.

Telescopic Conveyor Vehicles

Figure 1A:
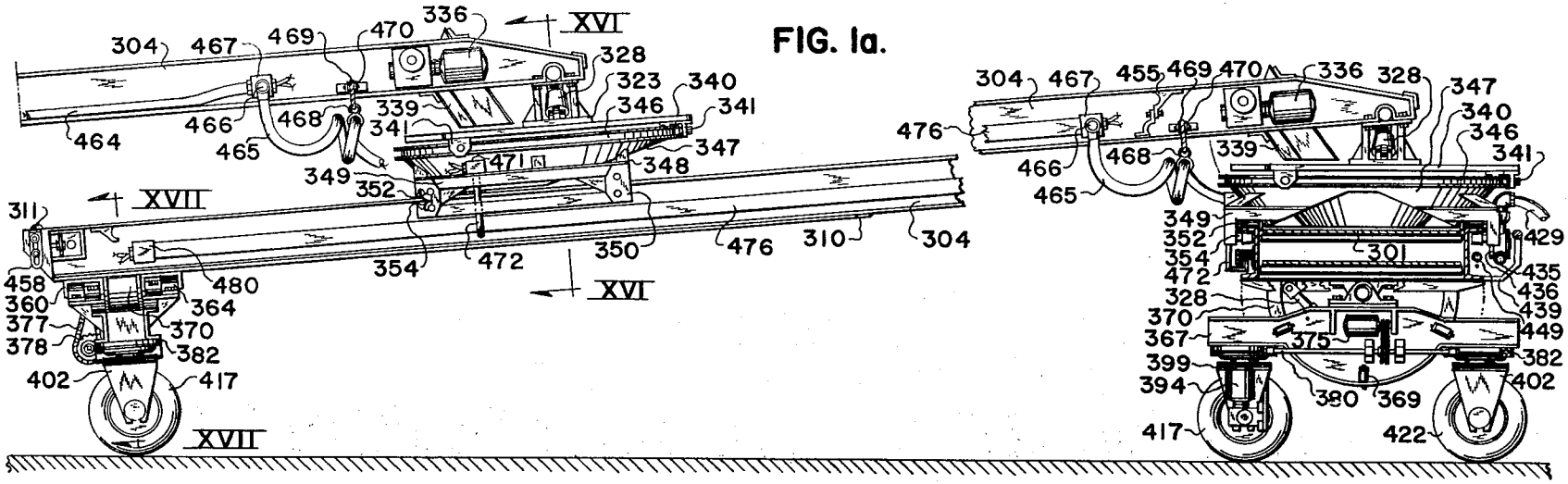
Figure 2A:
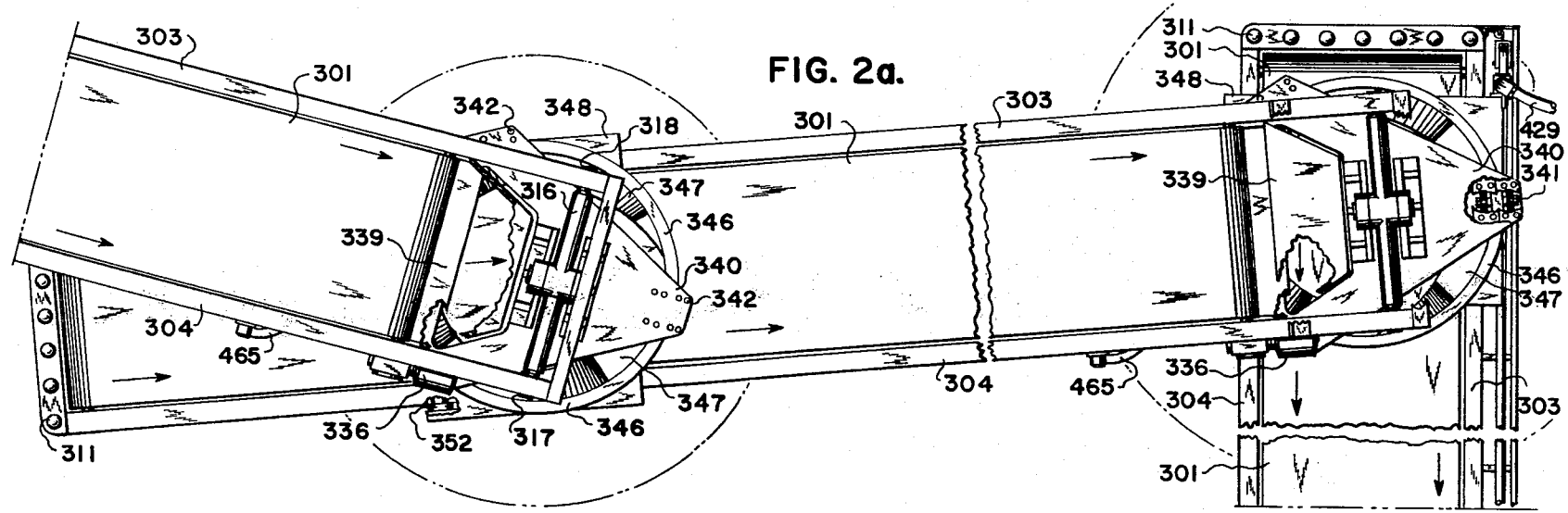
Figure 15:
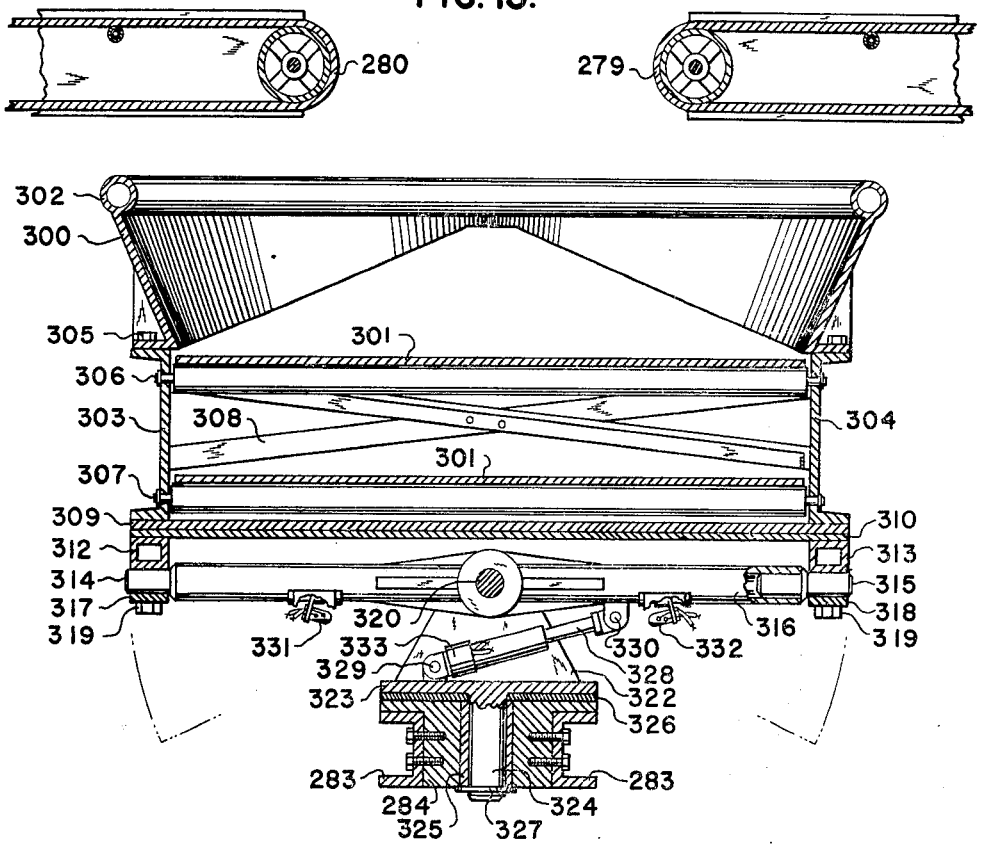
FIG. 15 is an enlarged vertical cross section taken as indicated along the angled arrows XV—XV of FIG. 1, illustrating details of the telescopic conveyor inby hopper, the universal tow bar providing automatic transverse leveling, longitudinal leveling and a vertical swiveled coupling means, and portions of the excavator vehicle's transverse outby conveyors.

Referring to FIGS. 1*a*, 2*a* and more particularly to FIG. 15, the inby section of the telescopic conveyors comprises the previously mentioned hopper 300 having a tubular rim 302 secured to the top of the hopper cone 300 the latter in turn is secured to the conveyor side channel bars 303 and 304 as by bolts 305. The outby side of the hopper cone 300 has a conical section removed, thereby forming an aperture having a generally triangular geometry to permit the earth to move on the endless conveyor belt 301 under the hopper rim 302. All of the other hoppers referred to in the specification have similar apertures. The conveyor belt 301 is supported by the outgoing rollers 306 and the return idlers 307. The angle bar cross braces 308 are bolted to the side channel bars 303 and 304. The "T" bar ribs 309 provide the supporting structure for the hull plate 310, the ribs 309 and the plate 310 are secured to the underside of the channel bars 303 and 304. The plate 310 extends from the rear end of the conveyor vehicle forwardly (FIG. 1*a*) to approximately twenty-five percent of the total length of the conveyor. The plate 310 prevents interference with the return idlers 307 and the belt 301 (FIG. 15) as the superimposed telescopic conveyor overrides the ball bearing fender 311 (FIGS. 1*a*, 2*a*) secured to the rear end of the lower connecting telescopic conveyor vehicle. The above arrangement permits the maximum travel between the adjacent connected telescopic conveyors without imposing a binding interference on each others conveyor belts and return idler rollers.

Referring now to FIG. 15, a pair of coupling brackets 312 and 313 are secured to the channel bars 303 and 304 respectively. The lower portion of the brackets 312 and 313 form bearings to receive the journals 314 and 315 of the universal tow bar 316, comprising a generally circular cross-sectional geometry. A pair of retainer plates 317 and 318 are secured to the lower portion of the brackets 312 and 313 as by screws 319. The above arrangement has a twofold purpose in that a quick coupling means is provided between the conveyors and the universal tow bars, and the coupling further provides a longitudinal pivotal means to compensate for the telescopic travel, terrain undulations and stacking of the conveyors for highway travel. A pair of trunnions 320 (See also FIG. 20) are longitudinally disposed and integral with the universal tow bar 316. The trunnions 320 are suitably journaled in bearings supported by the upstanding brackets 321 and 322 integral with the swivel base 323, the latter (FIG. 15) is provided with an integral downwardly extending shaft 324 suitably journaled in a radial bearing 325 and a thrust bearing 326. The shaft 324 is provided with a retainer ring 327. The bearings 325 and 326 are supported by the previously mentioned swivel block 284, the latter in turn is secured to the tow bars 283, in turn secured to the excavation vehicle. The above arrangement permits the excavation vehicle to maneuver about the vertical fulera 324 through an arc of approximately 330 degrees in relation to the inby section of the telescopic conveyor vehicle.

The conveyor transverse leveling means comprises a linear actuator 328, either electrically or hydraulically driven and will be hereinafter referred to in the specification as electrically driven. The actuator 328 is pivotally connected at 329 to the swivel base 323, the opposite end of the actuator 328 is pivotally connected at 330 to the downstanding brackets integral with the tow bar 316. The motor 333 of the linear actuator 328 is automatically activated by a pair of mercury switches 331 and 332 secured to the underside of the tow bar 316. The electrical circuits to the mercury switches 331 or 332 will become closed and activate the actuator 328 in a direction opposite to the transversely inclined excavation vehicle and the tow bar 316. The complete circuitry will be described later. The foregoing arrangement will rotate the conveyor and the connected tow bar 316 in either direction about their transverse fulera 320, thereby providing the capacity to return the conveyor to its original level position, after having been displaced by the excavation vehicle while maneuvering over transversely inclined terrain, thereby insuring the retention of earth on the conveyor belt 301. Referring to FIGS. 1*a*, 2*a* and more particularly to FIG. 16, the opposite end of the inby conveyor is provided with a ratiomotor 336 in turn drives the shaft 337 having keyed thereon a belt pulley 338, in turn drives the conveyor belt 301. The earth cascades from the conveyor belt 301 into the shute 339 having a generally trapezoidal cross sectional geometry. The shute 339 is secured to the side channel bars 303 and 304. The earth is then directed downwardly by the shute 339 through a generally trapezoidal aperture in the swivel plate 340 (See also FIG. 20). The inside perimeter of the aperture of the plate 340 is larger than the perimeter of the shute 339 thereby enabling the latter to enter the aperture of the plate 340 when subjected to the maximum longitudinal and transverse angular relationships between the superimposed conveyor and the supporting conveyor vehicle. The above arrangement will maintain an uninterrupted flow of earth onto the belt 301 of the receiving conveyor and will repeat the above cycle for each of the successive articulated conveyor vehicles.

The conveyor side channel bars 303 and 304 are longitudinally and transversely pivotally supported by the universal tow bar 316 in an identical manner perviously described for the inby end of the conveyor with a modification to the structural swivel means. The above-mentioned modification comprises a bracket base 323 secured to the above-mentioned swivel plate 340, the latter having a generally triangular outside geometry. The swivel plate 340 is supported by three pairs of downstanding brackets 341 secured to the former as by screws 342. The brackets 341 have six horizontally disposed stub shafts 343 secured thereto as by nuts 344. The distal ends of the shafts 343 are provided with lateral thrust ball bearings 335. The shafts 343 are further provided with suitable radial bearings in turn support the six flanged rollers 345. The rollers 345 are retained thereto and travel around the inside and the outside channels of the I beam rim 346, the latter in turn is secured to the top of the hopper 347 in turn is secured to the hopper car platform 348. The above arrangement supports the superimposed conveyor and also permits the swivel plate 340 and the supporting rollers 345 to rotate about a vertical axis in relation to the hopper car rim 346. The rollers 345 support a six point vertical thrust and a three point lateral thrust simultaneously on the hopper rim 346, regardless of the direction in which the pivotally connected conveyor vehicles may be towed or driven. The combination of the universal tow bar 316 and the attached swivel plate 340 provide a longitudinal, transverse and vertical pivotal means, insuring ample flexibility of movement about their respective fulera to maneuver the articulated excavation vehicle, the telescopic conveyor vehicles, and the distribution vehicle is practically any configuration desired. The before-mentioned hopper car assembly comprises a platform 348 having a generally square geometry outside and a generally crescent geometry on the inside. The platform 348 is supported by the frame 349 in turn is supported at each corner by downstanding brackets 350 the latter in turn have four upper horizontally disposed shafts 351 secured thereto and the hopper cone 347. The shafts 351 support suitable combination radial and thrust bearings the latter in turn support four double flanged rollers 352 in turn are supported by the upper flange treads of the conveyor channel bars 303 and 304. The brackets 350 are also provided with four lower horizontally disposed stub shafts 353 secured to the brackets 350. The distal ends of the shafts 353 support suitable bearings in turn support the four retaining guide rollers 354 extending inwardly into adjacency to the webs of the side channel bars 303 and 304. The above roller arrangement prevents the derailment of the hopper car, as the latter travels longitudinally to either end of the channel bars 303 and 304. The traveling hopper car provides a telescopic relationship between the articulated conveyor vehicles while simultaneously providing the means for a continuous flow of earth from the superimposed to the lower receiving conveyor regardless of the angular or telescopic relationships between the articulated conveyor vehicles.

The drive wheel end of the telescopic conveyor vehicles are also provided with a conveyor leveling means comprising a channel bar 360 (See FIGS. 1*a*, 16, and 18) secured transversely to the lower flanges of the conveyor channel bars 303 and 304. A pair of downwardly extending brackets 361 and 362 are secured to the channel bar 360. A longitudinal horizontally disposed shaft 363 is suitably journaled in bearings supported by a pair of upstanding brackets 364 and 365 the latter in turn are secured to the platform 366 the latter in turn is secured to a pair of transverse wheel supporting channel bars 367 and 368. The latter are provided with three pairs of guide rollers 369 (FIG. 16) suitably journaled in brackets secured to the respective channel bars 367 and 368. The rollers 369 are in rotative contact with the fore and after flanges of the semi-circular H beam guide 370 the latter in turn is secured to the channel bar 360. A linear actuator 328 is pivotally mounted at 372 to the downstanding brackets secured to the H beam 370, the lower end of the actuator 328 is pivotally mounted to a horizontally disposed shaft 373 (See also FIG. 17) in turn is pivotally mounted to the channel bars 367 and 368. The above arrangement permits the conveyor to rotate in either direction about its fulcra shaft 363 and still maintain the wheel supporting channel bars 367 and 368 in a position perpendicular to the longitudinal axis of the conveyor vehicle. The linear actuator 328 is activated by a pair of mercury switches secured to the channel bar 360, in an identical manner previously described for the inby section of the telescopic conveyor.

The foregoing arrangement provides a transverse leveling means wherein the conveyor section is maintained in a level state regardless of whether the excavation vehicle, or the ground engaging wheels of the supporting telescopic conveyor vehicle, travel over similarly inclined or diametrically inclined terrain.

Conveyor Vehicle Wheel Assembly

Figure 16:
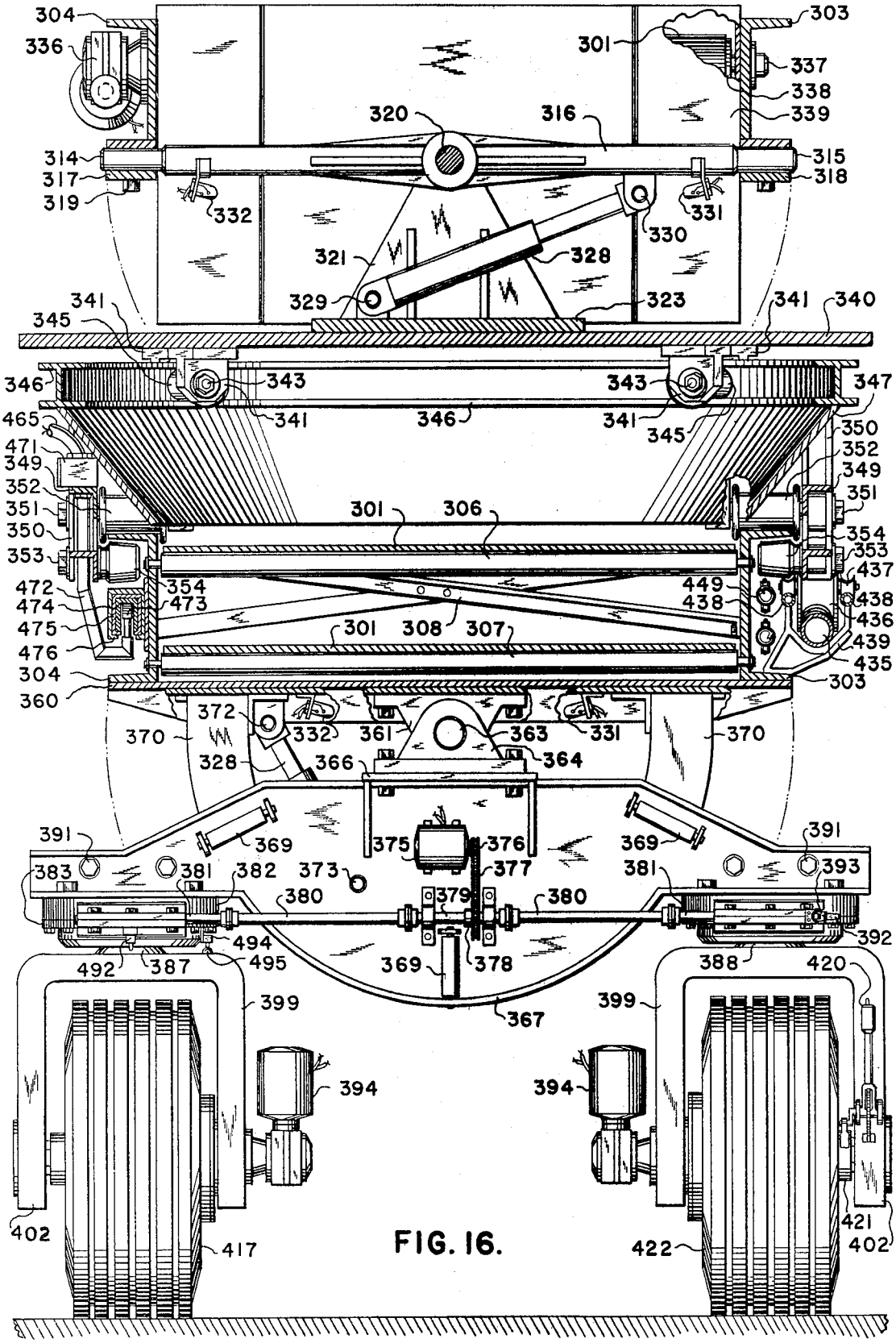
FIG. 16 is an enlarged vertical cross section taken as indicated along the angled arrows XVI—XVI of FIG. 1*a*, illustrating details of the universal tow bar, swivel plate and supporting rollers, traveling hopper car, telescopic electrical and water conduit means, conveyor leveling means, steering and drive wheel means.
Figure 17:
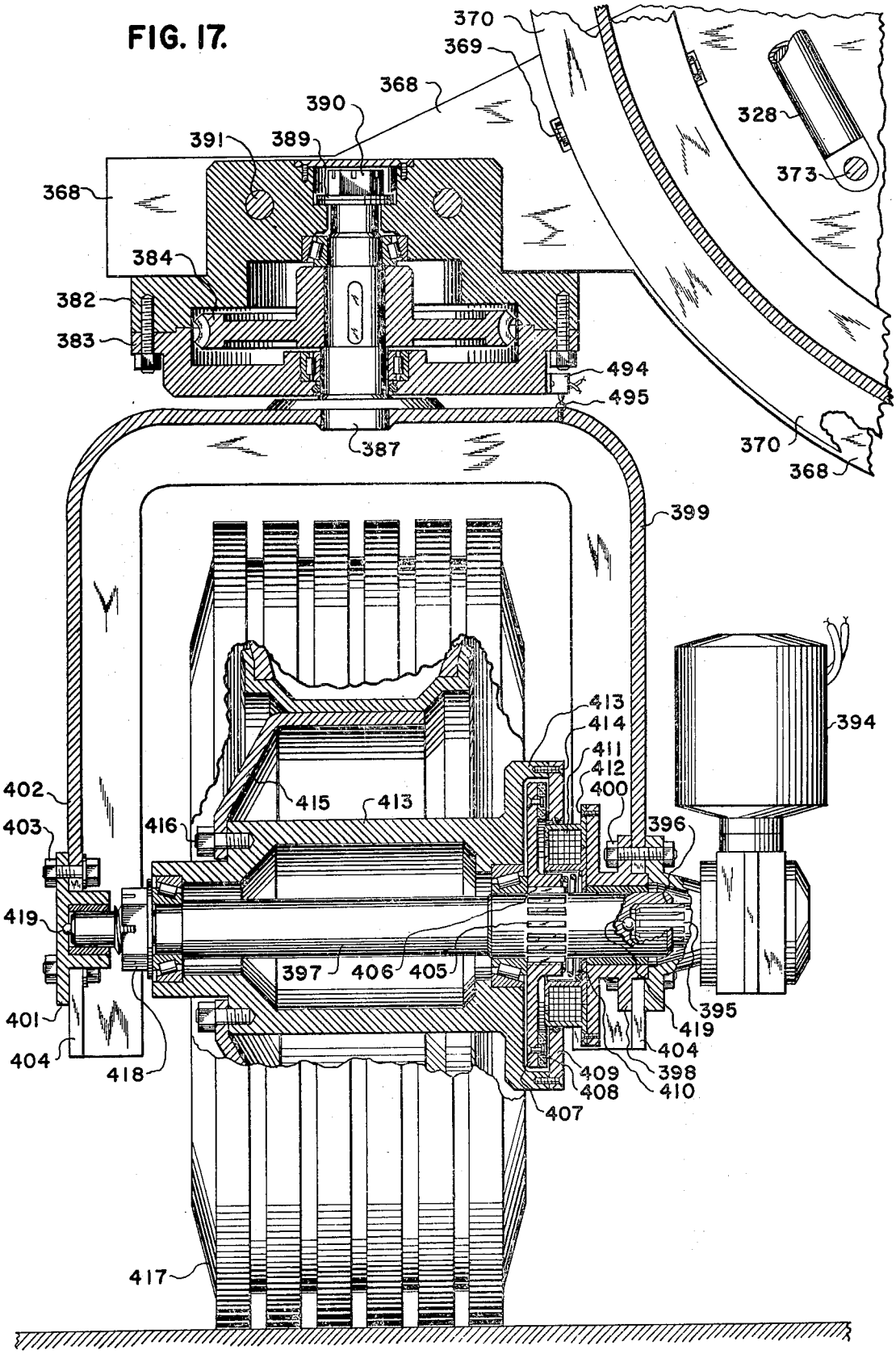
FIG. 17 is an enlarged vertical section taken as indicated along the angled arrows XVII—XVII of FIG. 1*a*, illustrating details of the telescopic conveyor drive wheel, steering, clutch and brake mechanism.

As best seen in FIG. 1*a*, 16 and 17 the conveyor wheel assembly comprises a steering braking, self-propulsion and towing means. The above means can be operated by manual or radio remote control from the operator's cab in the excavation and distribution vehicles as will be described later. Referring now to FIGS. 1*a* and 16, the range of the steering mechanism permits transverse or longitudinal travel of the conveyor wheels or may be direction oriented in any other selected degree between the above relative positions. The driving means for the steering device comprises a motor 375 secured to the channel bar 367. The motor 375 in turn drives the sprocket 376, chain 377 and the sprocket 378, the latter in turn having its hub keyed to the horizontally disposed steering shaft 379 the latter in turn is suitably journaled in bearings supported by the channel bar 367. The shaft 379 is coupled to intermediate shafts 380, the latter in turn are coupled to the worm shafts 381 in turn suitably journaled in bearings supported by the upper gear housing 382 and the lower gear housing 383. The worm shafts 381 (FIG. 17) have keyed thereon, within the housings, the worms (not shown) meshing with and driving the worm gears 384 having their hubs keyed to the vertical fork shafts 387 and 388 in turn suitably journaled in bearings supported by the gear housings 382 and 383. The shafts 387 and 388 are pivotally secured to the gear housings 382 by thrust washers 389 and the retaining nuts 390. The gear housings 382 are secured to the channel bars 367 and 368 as by bolts 391.

The distal end 392 of the right hand worm shaft 381 is suitably shaped to receive a hand crank to effect wheel alignment in the event of a power failure or to provide minute adjustments to coincide with a bench mark insuring parallelism with the longitudinal axis of conveyor when making preparations for highway travel. A suitable shaft locking device 393 is provided to lock the wheels in the adjusted position for highway travel. The steering mechanism is shown mounted to the channel bar 367 for purposes of illustration; however, the preferred location would be connected to the channel bar 368 as shown in FIG. 1*a*.

The conveyor wheel driving, clutching, braking, and the free wheeling means are best seen in FIG. 16 and more particularly FIG. 17, comprising a pair of ratiomotors 394 having their output drive shafts splined at 395 in turn engaging the splined tubular portion 396 of the horizontally disposed shaft 397, the latter in turn is suitably journaled in bearings supported by the double flanged bushing 398 in turn secured to the inboard fork tine 399 and the ratiomotor 394 as by bolts 400, the opposite end of the shaft 397 is supported by the flanged bushing 401 in turn is secured to the outboard fork tine 402 as by bolts 403.

The fork tines 399 and 402 are slotted at 404 to facilitate removal of the wheel assembly to effect repairs. The shaft 397 is further provided with an external spline at 405 in turn engages the internally splined hub at 406 of the slidingly engaged clutch-brake disc 407, the latter in turn is provided with a friction lining 408. The disc 407 is normally disengaged from the combination drive-brake plate 409 by the helical compression spring 410 thereby permitting the conveyor wheels 417 and 422 to be in a conditional state of free wheeling. A solenoid coil 411 is secured to the inboard flange of the bushing 398 as by screws 412. When the motor 394 and the solenoid 411 are energized, the clutch-brake disc 407 will be slidingly engaged and will load the friction lining 408 against the drive-brake plate 409 the latter is secured to the wheel hub 413 as by screws 414. The above arrangement will drive the wheels 417 and 422 to maneuver the conveyor or perform the function of an electric brake when the conveyor is being towed. The hub 413 is suitably journaled on bearings supported by the shafts 397. The wheel rim 415 is secured to the hub 413 as by studs 416. The tire 417 is secured to the wheel rim 415. The hub 413 is rotatively retained on the shaft 397 by the castellated nut 418. The shaft 397 is provided with ball bearings 419 to absorb the thrust load. A hand set parking brake 420 (FIG. 16) is secured to the outboard tine 402, the brake band 421 engages the periphery of the drive-brake plate 409 and the connecting portion of the wheel hub 413.

The operation of the foregoing conveyor wheel assembly will be described later with the conveyor circuitry.

Telescopic Water Conduit Assembly

Figure 18:
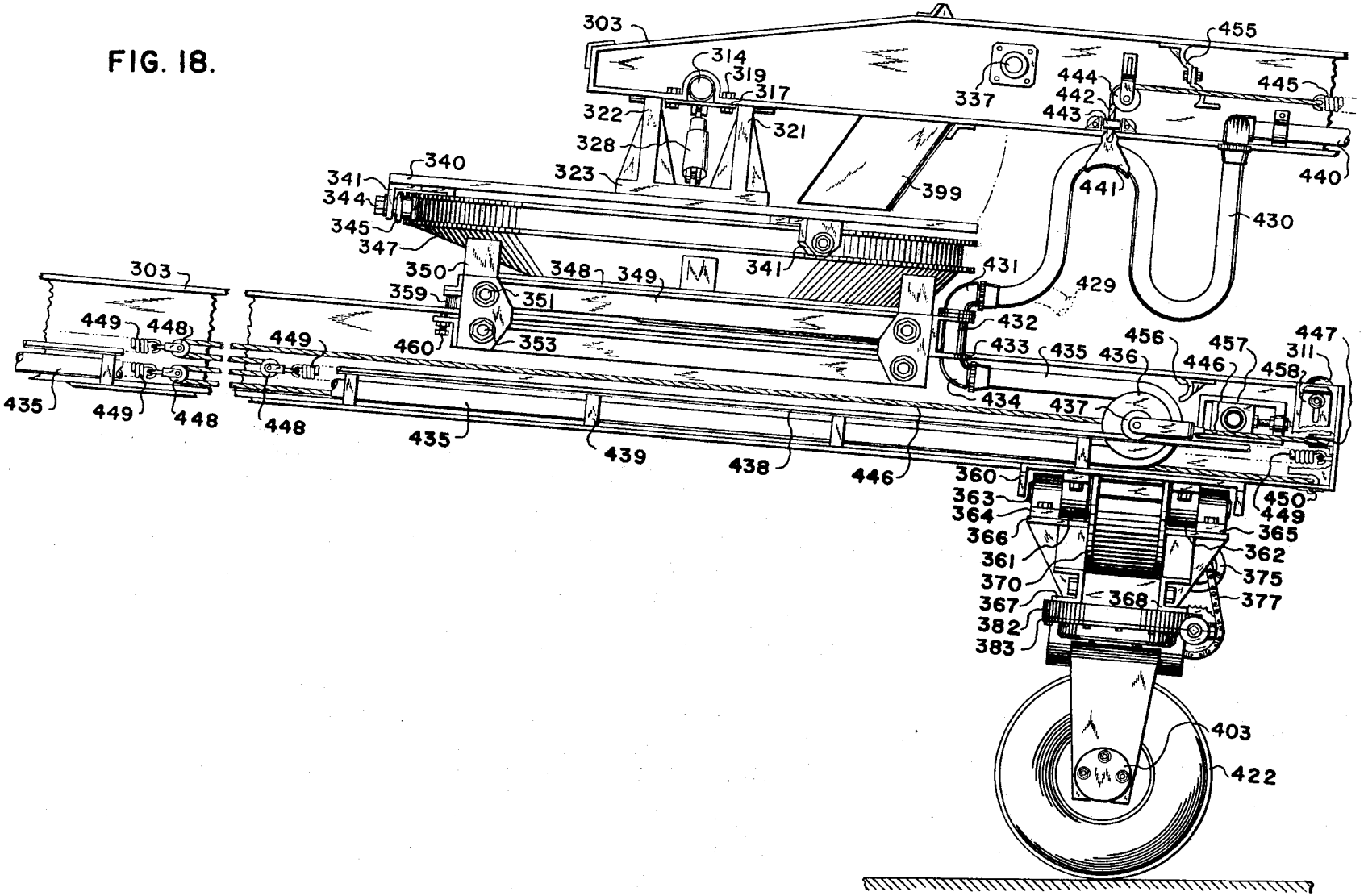
FIG. 18 is an enlarged side elevational view taken as viewed toward the right side of FIGS. 1*a* and 2*a*, illustrating details of the telescopic water conduit, connected to the superimposed telescopic conveyor, thence to the traveling hopper car, thence to the lower telescopic conveyor, and supported by a system of pulleys, springs, and cables.

Referring to FIGS. 1*a*, 2*a*, 16 and more particularly to FIG. 18, the telescopic water conduit means comprises a source of water from a fire hydrant or temporary water main, thence connected by a flexible supply hose 429 to any selected conveyor section. The connection of the above hose into the telescopic conveyor system should be preferably located at a pivot point in the conveyor train wherein a minimum of conveyor travel will be experienced, or support the hose above ground contact, thus reducing the abrasion to the hose 429, the latter in turn is threadedly connected to the swivel elbow coupling 431, in turn mounted to the standpipe 432 in turn secured to the bracket 433 of the hopper or frame 349. The lower end of the standpipe 432 is provided with a fixed elbow 434, in turn threadedly connected to a helical wire inserted neoprene hose 435 or other suitable material. The hose 435 is reeved around the hose sheave 436 the latter is supported by a pair of side pulleys 437 in turn are supported by a basket frame comprising a pair of guard rails 438 and the supporting brackets 439 in turn secured to the conveyor channel bar 303. The basket frame and hose 435 extend to the mid-length of the channel bar 303 wherein the hose 435 is threadedly connected to a fixed water pipe conduit 440 the latter in turn extends forward to the outby end of the conveyor channel bar 303. The water conduit 440 is threadedly connected to the flexible coupling hose 430 in turn supported by the saddle bracket 441 in turn secured to the wire cable 442 the latter is reeved through the guide pulleys 443 and 444 thence secured to the spring 445 in turn secured to the channel bar 303. The above arrangement prevents the hose 430 from interfering with the conveyor belt 301 and hopper car by providing the means to pay out and retract the hose 430 as the horizontal angular relationship changes between the superimposed conveyor vehicle and the supporting conveyor vehicle. The coupling hose 430 is threadedly engaged to the previously mentioned swivel elbow coupling 431 thus completing the water conduit cycle between the articulated conveyor vehicles. The short section of the coupling hose 430 is substituted for a long section of hose 429 for the previously mentioned source of water from the hydrant or temporary water main.

The telescopic hose retraction means comprises a spring tensioning device that becomes increasingly tensioned as the hopper car travels in a forward or telescoping direction, conversely when the hopper car travels in a rearward direction the spring loaded sheave 436 retracts the slackened hose 435 thus preventing the formation of a large slack loop that would inevitably escape from the basket frame or become entangled and possibly severed by the hopper car. The retraction of the sheave 436 is provided by a cable 446 in turn fair lead through a pair of sheaves 447 secured to the fender 311, the cable 446 is thence reeved through the sheaves 448 secured to the distal ends of the helical springs 449 in turn secured to the channel bar 303, the bitter end of the cable 446 is likewise secured at 450 to the channel bar 303. The above block and tackle arrangement permits the hose sheave 436 to travel to the mid-length of the conveyor while the hopper car travels the full length of the conveyor. It is feasible to use an encased flat spiral spring similar to the type used on portable extension cords to provide the required tension in lieu of the above block and tackle means.

The same telescopic extension and retraction means for the water conduit could be used for an electrical conduit in lieu of the thimrail telescopic electrical means to be described later.

The stops 455 and 456 are secured to each end of the conveyor channel bars 303 and 304 to limit the hopper car travel. The stop 455 is further provided with a clamping device to secure the stacked conveyors for highway travel as will be described later.

A pair of takeup frames 457 are secured to the channel bars 303 and 304 to adjust the tension of the conveyor belt 301.

A pair of slide clamps 458 are adjustably secured to both sides of the fender 311 for the purpose of securing the stacked conveyors for highway travel.

Four wire track brushes 459 are secured to the four downstanding brackets 350 to clear the tread surfaces of the channel bars 303 and 304 of any accumulated earth particles as the hopper car travels forward or rearward.

A pair of lock bolts 460 are provided to secure the hopper car in any desired position on the channel bars 303 and 304 where certain conditions may require immobility.

Telescopic Electrical Conduit Assembly

Referring to FIGS. 1*a* and 16, the inby conveyor section receives its electrical power from the excavation vehicle and delivers it through the electrical cable 464 to the junction box 467. The latter is provided with a male receptacle to receive the female plug 466 in turn secured to the inter-connecting power cable 465 with ground lead. The above arrangement provides the means to disconnect the power between the articulated conveyor vehicles. A portion of the cable 465 is precoiled and supported by a saddle bracket 468 in turn secured to the supporting wire cable 469 in turn reeved through a pulley 470 thence through a hole in the channel bar 304 thence connected to a system of pulleys and springs (not shown) located between the return idler rollers 307 and secured to the channel bars 303 and 304 in an identical manner previously described for the retraction means of the telescopic water conduit. The above arrangement provides the essential cable support, adequate slack, and retraction to permit the angular movement between the articulated conveyor vehicles.

The other end of the cable 465 is secured to the junction box 471 the latter is secured to the hopper car frame 349. The junction box 471 is provided with a downstanding insulated collector bar 472 (FIG. 16) in turn having mounted at its distal end a spring urged conductor shoe 473 the latter in turn is slidingly engaged and maintains contact within the electrical conducting hollows of the channel bar 474 in turn secured within the insulated channel 475 in turn secured within the supporting channel bar 476 the latter in turn is secured to the conveyor side channel bar 304. The above arrangement completes the telescopic circuit between the joined conveyor vehicles, regardless of their respective angular and telescopic relationships.

Conveyor Vehicle Electrical Circuit

Figure 19:
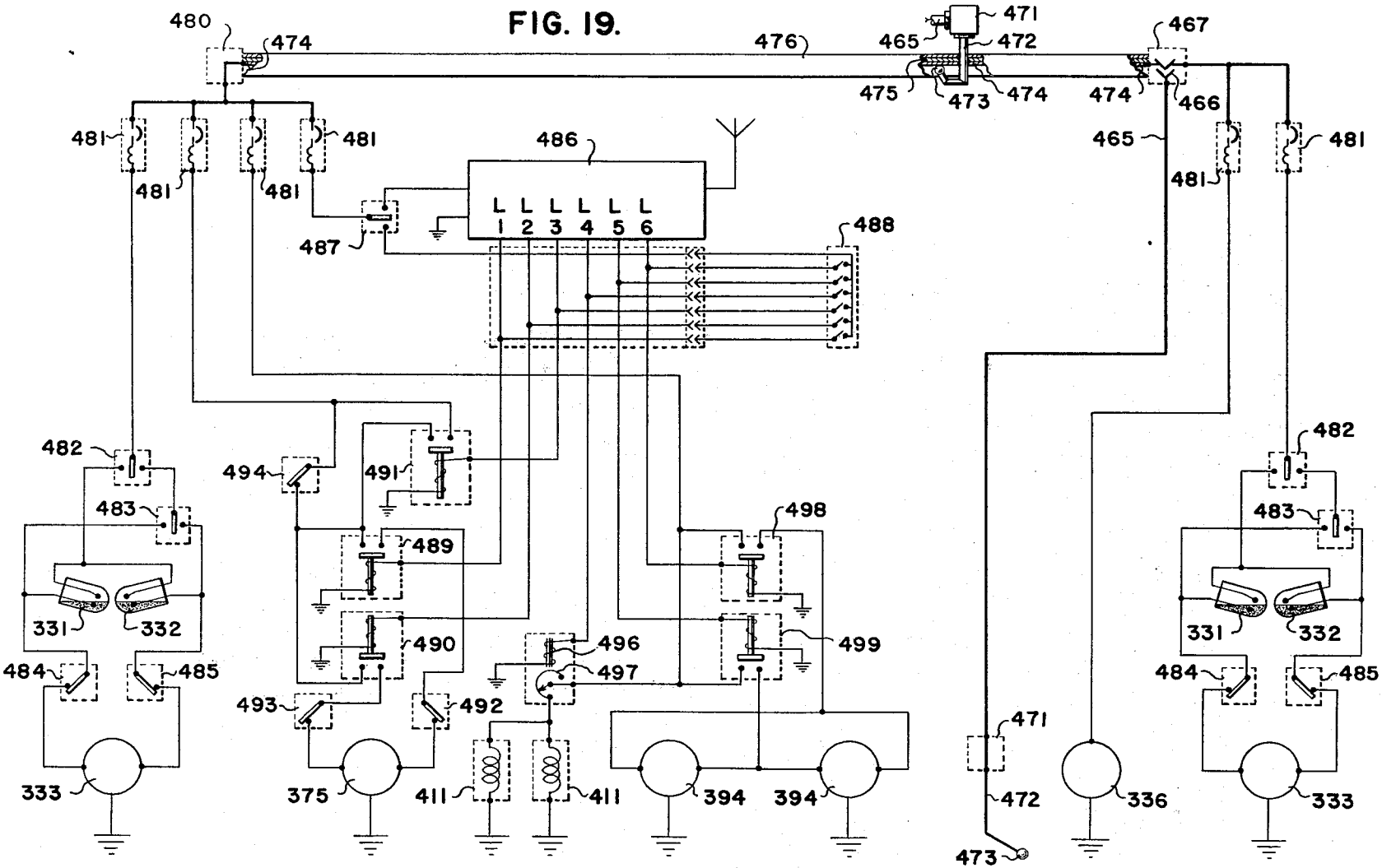
FIG. 19 is an electrical circuit wiring diagram of various electrical components required for controlling and effecting the operation of a telescopic conveyor vehicle.

Referring now to the schematic wiring diagram FIG. 19, the electric current for energizing the motors, solenoids and control circuits is supplied from generators located in the excavation and distribution vehicles. It is foreseeable that a large number of connected conveyor vehicles may require one or more auxiliary generators mounted to the channel bars 303 and 304 forward of the shute 339. The electrical circuit is grounded between the vehicle frames. As seen in FIGS. 1*a* and 19, the outby end of the insulated electrical conduit channel 474 is provided with the junction box 467 supplying power to the conveyor motor 336, the outby stabilizer motor 333 for the linear actuator 328 and the male receptacle for receiving the female plug 466 of the conveyor vehicle inter-connecting power cable 465. The inby end of the electrical conduit channel 474 is provided with a junction box 480 in turn provides power to the inby stabilizer motor 333, steering motor 375, drive wheel motors 394 and clutch-brake solenoids 411. In the interest of brevity only one conveyor transverse stabilizer circuit will be described. The stabilizer circuit comprises a pair of manually operable double throw switches 482 and 483, a pair of automatically operable mercury switches 331 and 332, a pair of limit switches 484 and 485 and a stabilizer motor 333.

Thereupon, by shifting the switch 482 leftward a circuit is established to the automatic mercury switches 331 and 332 which provide the means to automatically maintain the conveyor in a level position, as an example, the wheel assemblies may become transversely inclined as would occur on a hillside, raising the left wheel 417 above the horizontal plane of the right wheel 422 (See FIG. 16) causing the mercury in the switch 331 to bridge the contacts and establish a circuit to the motor 333 for rotation in the proper direction to drive the actuator shaft 328 and cause the conveyor frame to be moved counterclockwise about its fulcra 363 as previously described, lowering the inclined side of the conveyor belt 301 to a horizontal plane, when the motor 333 is automatically stopped through the opening of the circuit thereto as the mercury levels off in the switch 331 clear of the contacts in the latter, conversely, raising the right wheel 422 above the left wheel 417 will cause the mercury switch 332 to close and return the conveyor to a level position as previously described. The limit switches 484 and 485 are in series with the motor 333 and will be opened immediately before the conveyor frame reaches its maximum transverse travel position, thereby interrupting the operation of the motor 333.

Thereupon, by shifting the switch 482 to the center or off position an interlock feature (not shown) will prevent accidental activation of the mercury switches 331 and 332 when servicing the conveyor or when traveling at high speeds where jouncing of the mercury could feasibly activate both switches and create damage to the motor 333. Thereupon, by shifting the switch 482 to the rightward a circuit is established to the manual control switch 483, thereby permitting rotation of the motor 333 in either direction when manual operation is desired. The description of the above stabilizer circuit is identical for all of the other stabilizer assemblies.

The manual control switch 483 is provided for use when servicing the mechanisms or jogging the conveyor leveling means.

The radio remote control receiver 486 is provided to maneuver one or more conveyor vehicles simultaneously by means of selected frequency modulations transmitted from either the excavation or distribution vehicle as programmed.

Thereupon, by shifting the manually operable switch 487 upward a circuit is established to the radio control receiver 486. Thereupon, by shifting the switch 487 to the center or off position, certain conveyor sections could be selectively isolated from radio response, wherein permanence of location is desired, viz., a pivot point in the conveyor train. Thereupon, by shifting the switch 487 downward a circuit is established to the manual control switch 488 which may be used for maneuvering or servicing an individual conveyor vehicle.

The steering circuit comprises relays 489, 490 and 491, limit switches 492, 493 and 494 and the motor 375. Thereupon by energizing the line L-1 the contacts of the relay 489 will close and establish a circuit through the normally closed limit switch 492 to the motor 375 for rotation in the proper direction to drive the worm shafts 381 and cause the worm gears 384 (FIGS. 16, 17), wheel forks 387 and 388 to be moved about their axes until the motor 375 is automatically stopped through opening of the circuit in the limit switch 492 by means of the interrupting lug 495 (FIG. 16) secured to the top of the tine 399 of the fork 387 in parallelism with the wheel axis. Energizing line L-2 will cause, through the interposing instrumentalities a reversal of motor 375 by means identically described for the line L-1. The limit switches 492 and 493 are secured to the gear housing 382 at diametrically opposite positions in parallelism with the longitudinal axis of the conveyor, thereby permitting forks 387 and 388 to rotate within a range of one hundred eighty degrees, being automatically interrupted at the midway point of rotation by means of the lug 495, opening the circuit in the neutral limit switch 494, secured to the gear housing 382 and mounted on an arc ninety degrees between the limit switches 492 and 493, and in parallelism with the transverse axis of the conveyor, thereby permitting automatic stops on the most commonly used wheel alignments. If desired, additional automatic stops could be installed by identical means described above for the neutral switch 494. The energizing of line L-3 will close the contacts in the overriding relay 491, initiating operation of the motor 375 through the previously mentioned relays 489 or 490 to rotate the forks 387 and 388 sufficiently to permit the lug 495 to be removed from contact with the neutral switch 494, thus closing the interrupted circuit. Line L-3 may then be deenergized until rotation through the midway point is again desired.

The clutch-brake circuit comprises the solenoid 496 connected to a spring urged dashpot (not shown) in turn pivotally connected to the rheostat 497. The energizing of the Line L-4 will cause the solenoid 496 to rotate the rheostat 497 counterclockwise from zero field strength thence gradually increasing until the maximum field strength is imparted to the clutch-brake solenoids 411, thus causing the clutch-brake disc 407 (FIG. 17) to load the friction lining 408 against the drive-brake plate 409 to drive the wheels 417 and 422 or function as an electric brake as previously described. The de-energizing of Line L-4 will cause the spring urged dashpot (not shown) to rotate the rheostat 497 in a clockwise direction, thus diminishing the field strength of the solenoids 411 to zero.

When towing the conveyor vehicles on a highway it would be best to run a special brake electric wire from the clutch-brake solenoids 411 of the conveyor vehicle functioning as a supporting trailer for the other stacked trailers. The special brake wire would then be connected to a conventional electric brake rheostat mounted to the steering column of the towing vehicle. The above rheostat can be hand activated or activated by the towing vehicle's brake hydraulic fluid lines. The latter provides a syncronization of brake power between the towing and the towed vehicle.

The drive wheel circuit comprises a pair of relays 498 and 499 and a pair of drive wheel motors 394. Thereupon, by energizing the line L-5 the contacts of the relay 499 will close and establish a circuit to the motors 394 for rotation of the drive wheels 417 and 422 and subsequent self-propulsion drive of the conveyor vehicle in the desired direction. The energizing of Line L-6 will close the contacts on the relay 498 and reverse the motors 394.

Modification to the Telescopic Conveyor Vehicle

It is conceivable that certain open pit mining operations conducted on relatively flat terrain would not require the conveyor leveling, steering, self-propulsion, and the water conduit means, thus a more simplistic version of the first embodiment would suffice.

The lateral realignment of the telescopic conveyors could be accomplished by a fork lift.

Dualistic Distribution Vehicle Assembly

Figure 1B:
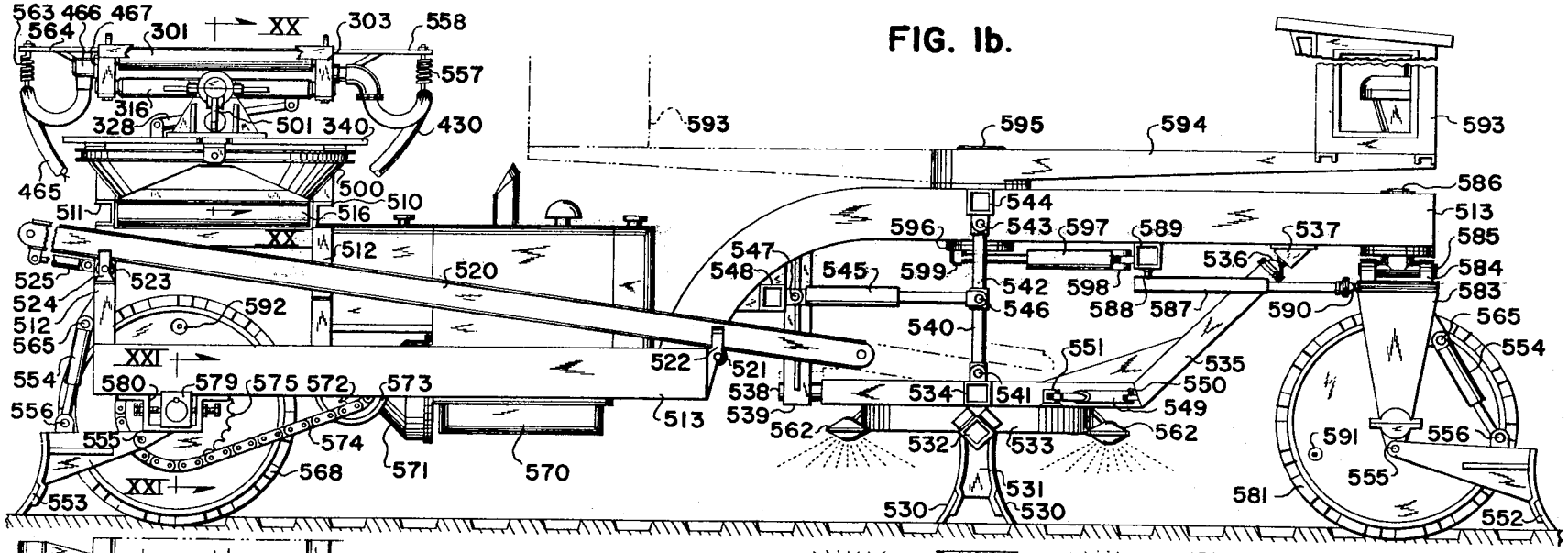
Figure 2B:
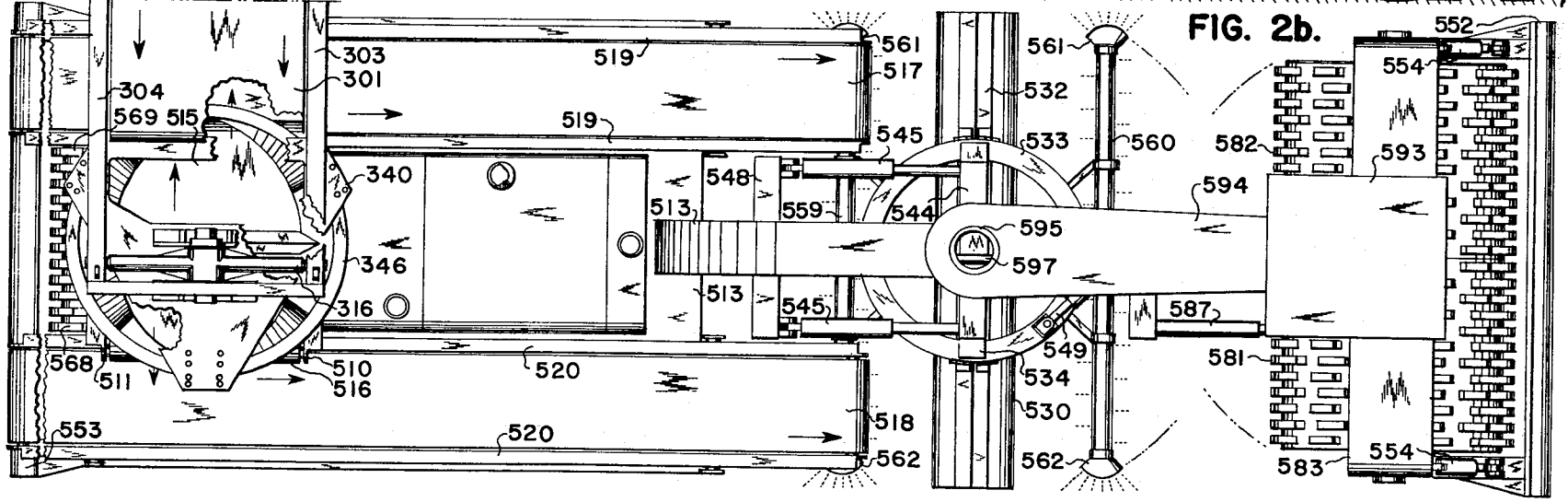
Figure 21:
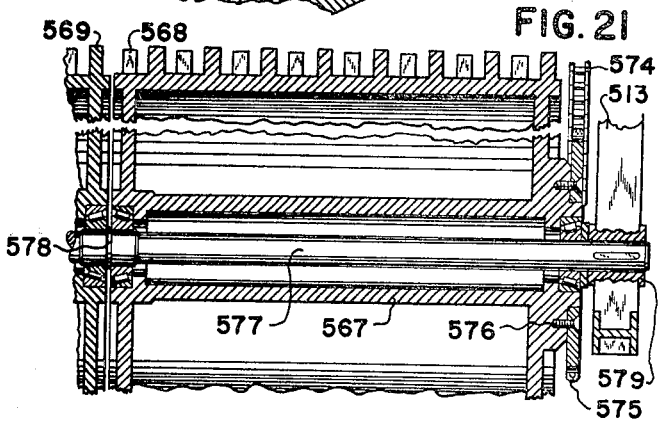
FIG. 21 is a vertical section taken as indicated along the angled arrows XXI—XXI of FIG. 1*b*, illustrating details of the distribution vehicle impactor wheel drive means.
Figure 20:
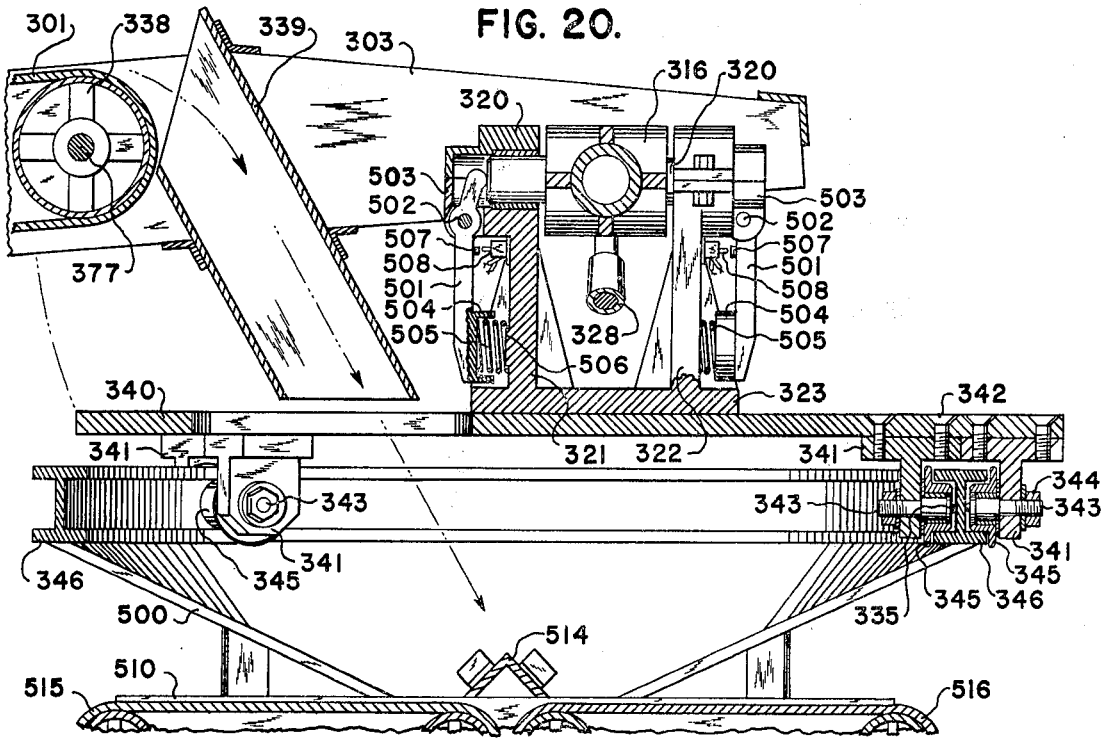
FIG. 20 is an enlarged fragmentary vertical section taken as indicated along the angled arrows XX—XX of FIG. 1*b*, illustrating details of the distribution vehicle load sensing alarm, conveyor shute, apertured swivel plate and supporting rollers, fixed hopper and oppositely driven transverse belt conveyors.

Referring now to FIGS. 1*b*, 2*b*, 21 and more particularly to FIG. 20. The multi-function distribution vehicle, comprises an earth conveying, distributing, wetting, grading and impacting means. The inby end of the distribution vehicle conveyor means is provided with a universal tow bar 316 in turn secured to the swivel plate 340 in turn is rotatively borne to the inby hopper 500 in an identical manner previously described for the telescopic conveyors. The above arrangement permits the distribution vehicle to rotate about the vertical axis of the hopper 500 and the swivel plate 340 through an arc of approximately 330 degrees in relation to the connected telescopic conveyor vehcle.

Load Sensing Alarm Assembly

Referring to FIG. 20, a load sensing alarm is provided to warn the operators of the excavation and distribution vehicles that they have exceeded the forward or rearward travel limitations between their respective vehicles and the telescopic conveyor sections. The alarm mechanism is secured to the upstanding brackets 321 and 322. Adequate clearance has been provided between the trunnion shoulders 320 of the universal tow bar 316 and the above-mentioned upstanding brackets in order to permit the trunnions to float and engage the lever 501 in turn is pivotally connected to a transverse shaft 502 suitably journaled in bearings supported by the bearing housing 503.

The distal end of the lever 501 is provided with a spring retainer cup 504, the latter in turn retains the helical compression spring 505 in turn is retained by a boss 506 integral with the upstanding brackets 321 and 322. An alarm activating lug 507 is integral with the lever 501. The alarm switch 508 is secured to the upstanding brackets 321 and 322. The above arrangement will activate a suitable alarm mounted in the operator's cab whenever the longitudinal force generated by the excavation or distribution vehicles exceed the compression resistance of the helical spring 505. An identical load sensing alarm is provided for the inby universal tow bar 316 of the excavation vehicle.

Distribution Vehicle Conveyor Assembly

The hopper 500 is secured to the transverse conveyor channel bars 510 and 511 the latter in turn are secured to the vertical conveyor supporting frame 512, the latter is secured to the longitudinal vehicle frame 513. The earth cascades from the conveyor belt 301 downwardly through the shute 339 thence through the aperture in the swivel plate 340 thence onto the divisional bar 514 thence onto the oppositely driven transverse conveyor belts 515 and 516, the latter are driven in an identical manner described for the belts 251 and 252 of the excavation vehicle. There are two diametrically opposed apertures in the hopper 500 to permit the earth to be conveyed under the hopper rim 346 by the belts 515 and 516, the latter in turn discharge the earth onto a pair of longitudinal conveyors 517 and 518 (FIGS. 1*b* and 2*b*) in turn are supported by the conveyor channel bars 519 and 520 respectively. The latter in turn are supported at the forward end by the rollers 521 in turn supported by the brackets 522 in turn secured to the frame 513. The rear end of the conveyor channel bars 519 and 520 are supported by rollers 523 in turn supported by brackets 524. A pair of linear actuators 525 are pivotally mounted at one end to the frame 512, the opposite end of the actuators 525 are pivotally mounted to the conveyor channel bars 519 and 520. The above arrangement permits the extension or retraction of the conveyor channel bars 519 and 520 thus enabling the belt conveyors 517 and 518 to discharge the earth ahead of the double faced grader blade 530, regardless of whether the distribution vehicle is traveling in a forward or rearward direction.

Earth Distribution and Grading Assemblies

Referring to FIGS. 1*b* and 2*b*, the earth distribution and grading assemblies comprise a pair of grader blades 530 secured back to back by the web plates 531. The grader blades 530 and the web plates 531 are in turn secured to the transverse box beam 532 the latter in turn is secured to the circle frame 533 in turn mounted to the transverse cross beam 534 and the longitudinal tow beam 535, as by offset guide brackets (not shown). The tow beam 535 is pivotally mounted to the ball 536, the latter in turn is secured to the bracket 537 in turn secured to the frame 513. The opposite end of the beam 535 is provided with a journal 538 that is slidingly engaged within the tines of the downstanding lateral thrust bracket 539 the latter in turn is secured to the frame 519. A pair of toggle joints have their lower levers 540 pivotally mounted at 541 to the beam 534, the upper levers 542 are pivotally mounted at 543 to the beam 544. A pair of linear actuators 545 are pivotally mounted at 546 to the lower and upper levers 540 and 542. The opposite ends of the actuators 545 are pivotally mounted at 547 to the beam 548, the latter in turn is secured to the frame 513. The retraction or extension of the linear actuators 545 will raise or lower the grader blade 530. The circle frame 553 is provided with a linear actuator 549, pivotally mounted at 550 to the beam 535. The opposite end of the actuator 549 is pivotally mounted at 551 to the circle frame 533. The extension or retraction of the actuator 549 will rotate the circle frame 533 and the attached grader blade 530 about the former's vertical axis to provide a means for the distribution of the cascading earth fill and for the grading of the impacted road bed while the vehicle is traveling in a forward or rearward direction.

A pair of bulldozer blades 552 and 553 are pivotally connected at 555 to each end of the vehicle. Two pair of linear actuators 554 are pivotally connected at 556 to the blades 552 and 553 the opposite end of the actuators 554 is pivotally connected at 565 to the fork 583 and the frame 512. The above arrangement provides the means to spread the windrows created from each pass of the grader blade 530 as the vehicle travels in a forward or rearward direction.

Water Sprinkling Assembly

The water for wetting the earth fill and the adjacent areas is supplied from the previously mentioned telescopic water conduit means. The flexible coupling hose 430 is supported by an alternate system comprising the spring 557, the latter in turn is supported by an outrigger bracket 558, in turn hingedly mounted to the conveyor channel bar 303. A pair of water sprinkler control valves (not shown) are provided to control the supply of water to the transverse sprinkler pipes 559 and 560, the latter in turn are secured to the circle frame 533. The above sprinkler pipes are provided with suitable holes to wet down the cascading earth from the above-mentioned conveyors 517 and 518 and the areas forward and rearward of the grader blade path, regardless of the direction of travel. The distal ends of the sprinkler pipes 559 and 560 are provided wth terminal nozzles 561 and 562 to wet down the areas adjacent to the vehicle path.

It is also highly desirable to install foglike water spray nozzles on the shutes 339 of the telescopic conveyors and other locations on the excavation and distribution vehicles where the earth cascades from the superimposed conveyors, in order to reduce air pollution and subsequent health hazards and to improve visibility.

As previously mentioned, an electrical power supply is provided for one half of the conveying system by the excavation vehicle and the other half is supplied by the distribution vehicle. The engine driven generator (not shown) supplies power to the cable 465 in turn supported by the spring 563 in turn secured to the outrigger 564 the latter in turn is hingedly secured to the conveyor channel bar 304. The cable plug 466 is plugged into the male junction box 467 the latter in turn is connected to the insulated conduit channel bar 476 in turn secured to the conveyor channel bar 304 as previously described. The above arrangement completes the electrical circuit to the telescopic conveyors.

Impactor Wheel Assemblies

The rear impacter wheels 568 and 569 are driven by the motor 570 in turn drives the transmission 571 and the conventional differential (not shown) in turn drives a pair of conventional transverse drive shafts (not shown) in turn connected to a pair of chain drive sprockets 572. The drive shafts are supported by the conventional shaft housings in turn secured to the vehicle frame 513. A pair of brakes 573 are secured to the shaft housing and the brake drums are secured to the drive shaft in a similar manner shown in FIG. 4 of the excavation vehicle. The chain sprockets 572 drive the chain 574 in turn drives the sprockets 575, the latter (see FIG. 21) in turn are secured to the impactor wheel drums 568 and 569 as by screws 576. The hubs 567 of the impactor wheel drums 568 and 569 are suitably journaled in bearings supported by the horizontally disposed shaft 577 the latter in turn is provided with an annular shoulder at 578 to provide sufficient clearance between the inboard wheel bearings and the adjacent impactor wheels 568 and 569. The shaft 577 is keyed to the slidingly engaged shaft blocks 579, the latter in turn supports the vehicle frame 513 (see FIG. 1*b*). The blocks 579 are longitudinally adjustable to compensate for the wear of the chain 574 by the take-up frame 530. The above drive means in conjunction with a differential provides a division of driving forces between the impactor wheels 568 and 569 thereby permitting a difference in wheel speeds while turning curves, similar to the drive means of conventional automobiles. The forward impactor wheels 581 and 582 support suitable bearings in turn support a horizontally disposed shaft in an identical manner described for the rear impactor wheels. The above-mentioned shaft is keyed to the tines of the fork 583, the top of the fork 583 is provided with a pair of integral upstanding brackets 584, in turn supports a horizontally disposed shaft 585 the latter in turn supports the horizontal portion of the vertically disposed fork shaft 586 the latter in turn is pivotally mounted to the vehicle frame 513. A linear actuator 587 is pivotally mounted at 588 to the beam 589 the latter in turn is secured to the frame 513, the opposite end of the actuator 587 is pivotally mounted to the ball 590 the latter in turn is secured to the wheel fork 583, thereby providing a steering means for the vehicle. The periphery of the front and rear impactor wheel drums 568, 569, 581 and 582 are provided with impacting lugs. The above impactor wheel drums are watertight and may be ballasted with water for additional weight through the fill plugs 591 and 592.

It is feasible to interchange different types of impactor wheels, viz., sheepsfoot and smooth surfaced roller wheels.

Operator's Cab Assembly

The operator's cab 593 is supported by the bracket lever 594 the latter in turn having its hub keyed to the vertically disposed tubular shaft 595 the latter in turn is suitably journaled in bearings supported by the frame 513. The tubular shaft 595 provides a passageway for the vehicle's electric and hydraulic control conduits. The lower end of the shaft 595 has a bell crank 596 keyed thereon. A linear actuator 597 is pivotally mounted at 598 to the beam 589, the opposite end of the actuator 597 is pivotally mounted at 599 to the bell crank 596. The above arrangement provides the means to rotate the cab 593 approximately 180 degrees thereby permitting the operator an unrestricted view of the vehicle's path and a view of the face of each grader blade 530 as the vehicle travels in a forward or rearward direction.

First Modification to the Excavator Vehicle

Figure 22:
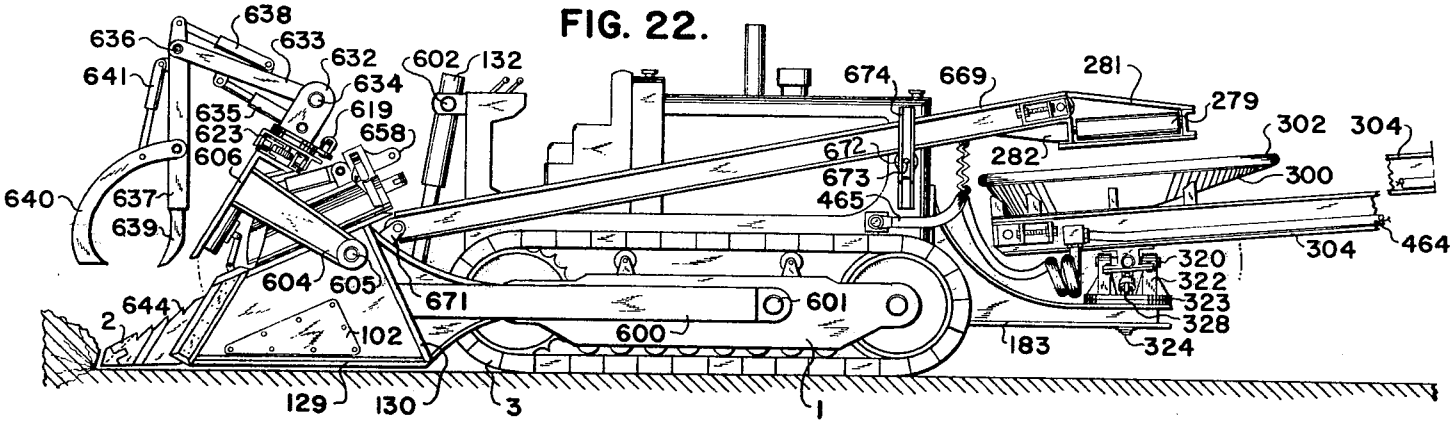
FIG. 22 is a side elevational view of the first modification to the earth excavator vehicle illustrating a cutterhead assembly pivotally mounted to the front of the vehicle.
Figure 23:
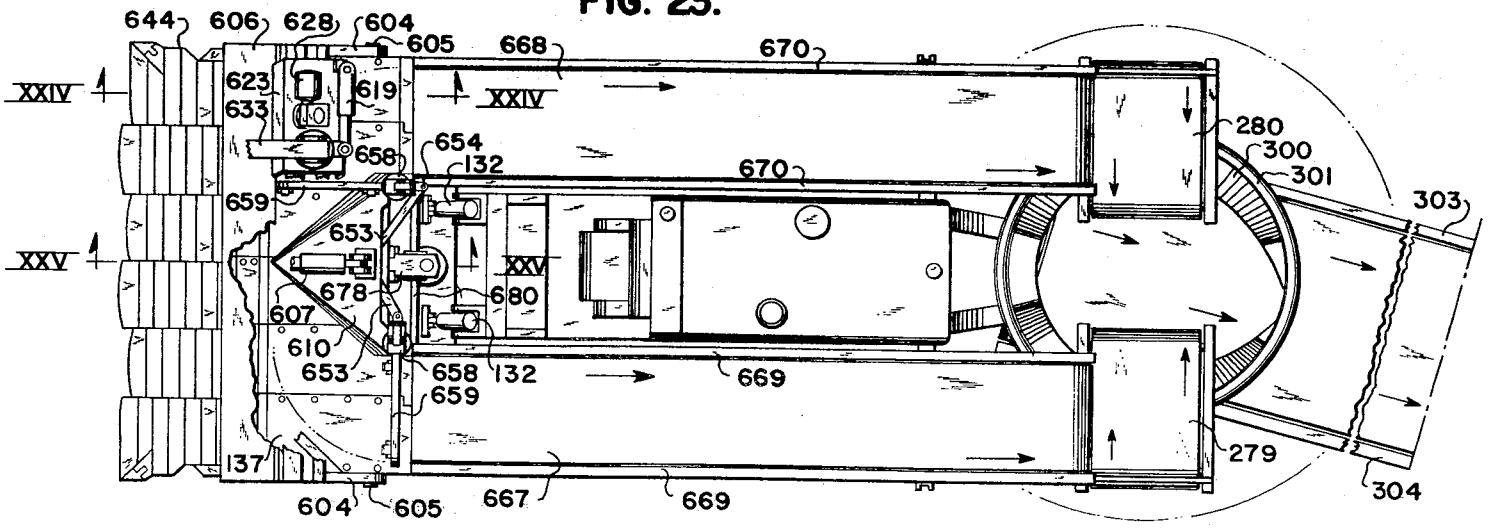
FIG. 23 is a plan view of FIG. 22, illustrating the cutterhead assembly, dozer blade, ejecting device, reciprocatory conveyors and belt conveyors.

Referring to FIGS. 22 and 23, the modified excavation vehicle with conveying means comprises certain components having their counterparts in the first embodiment of the invention and are identified by the same reference numerals and only those features requiring a change of parts are identified by new reference numerals in the "600" series. The principal change is that the excavation vehicle is provided with a combination bulldozing and front end loading means, a reciprocatory and belt conveying means secured to the cutterhead assembly. A pair of inclined inby belt conveyors are pivotally mounted outboard of the tractor engine and superimposed over the tractor link belts, thereby providing a more compact excavation and conveying means suitable for mounting to a conventional crawler tractor. The excavation vehicle 1 comprises a pair of drawbars 600 pivotally mounted at 601 to each side of the tractor 1. The distal ends of the drawbars 600 are secured to the cutterhead assembly frame 130. A pair of linear actuators 132 are pivotally mounted at 602 to the tractor 1, the opposite ends of the actuators 132 are pivotally mounted at 603 to the frame 130 of the cutterhead assembly. The extension or retraction of the actuators 132 will adjust the height of the cutterheads 2 in relation to the ground engaging surface of the tractor endless belt treads 3. A pair of lever arms 604 are pivotally mounted at 605 to the cutterhead assembly frame 130. The distal end of the levers 604 are secured to a bulldozer blade 606 (See also FIG. 25). A linear actuator 607 is pivotally mounted at 608 to the blade 606, the opposite end of the actuator 607 is pivotally mounted at 609 to the diversion box 610, the latter in turn is secured to the threshold plates 137. The extension or retraction of the actuator 607 will adjust the height of the dozer blade 606 in relation to the top of the cutter-head assembly. The height adjustment serves a twofold purpose in that when the blade 606 is lowered to a point just above the cutterheads 2, a bulldozing function may be performed with the additional advantage of the reciprocatory cutterheads fracturing and dislodging the earth. Conversely, raising the blade will convert the excavation vehicle into a self-loading front end leader with a conveying means. The height of the blade also regulates the volume of earth flowing into the conveying system.

The size of the rock fragments entering the conveying means is controlled by the height of the blade 606 in conjunction with the rock screening bars 611, the latter is pivotally connected at 612 to the dirt seal plates 183, the opposite end of the bar 611 is pivotally connected at 613 to a slipper plate 614 in turn is slidingly engaged to the slipper guide 615 in turn secured to the dozer blade 606. The above arrangement provides the means to adjust the height of the blade 606 and still maintain the vertical rock screening means, thereby preventing rock jams in unobserved remote areas of the conveying system.

Ejector Assembly

An ejecting device is secured to the top of the blade 606 for the purpose of ejecting oversized rocks and unwanted debris from the front of the blade 606. The ejector tracks comprise an H bar 620 and a channel bar 621 secured to the bracket 622 in turn is secured to the blade 606. The bars 620 and 621 are in parallelism with and extend to each end of the blade 606. The ejector car platform 623 is provided with downstanding brackets 624 and 625 in turn have four stub shafts 626 secured thereon, the shafts 626 support suitable bearings in turn support the flanged rollers 627. Secured to the car platform 623 is a ratiomotor 628 (FIG. 23) having keyed to its output shaft a spur gear 629 (FIG. 25) meshing with the gear rack 630 in turn secured to the H bar 620. The above arrangement provides the means to drive the ejector car 623 transverely on the blade 606. A linear actuator 619 is pivotally connected at one end to the car 623 and the opposite end is pivotally connected to the swivel base 631, the latter in turn supports a pair of upstanding brackets 632 the latter in turn supports a boom 633 pivotally connected at 634. A linear actuator 635 will raise or lower the boom 633, in turn has pivotally connected at 636 a boom 637. The linear actuator 638 will move the boom 637 in a forward or rearward direction. The distal end of the boom 637 is provided with a thumb bar 639 and a pair of fingers 640. The linear actuator 641 will open and close the fingers 640. The above arrangement provides the means to dislodge, grasp and discharge oversize rocks and debris to either side of the path taken by the excavator vehicle 1.

Figure 26:
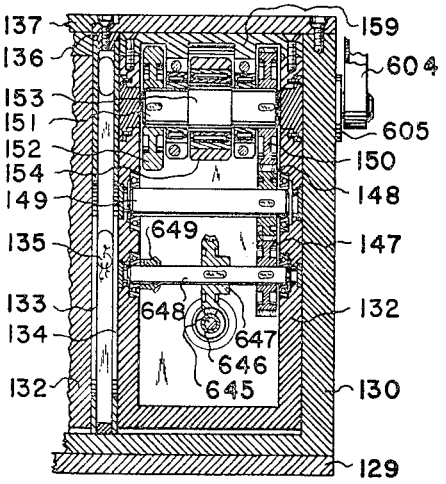
FIG. 26 is a vertical section taken as indicated along the angled arrows XXVI—XXVI of FIG. 24, illustrating details of an individual drive motor for each cutterhead drive mechanism to provide random striking of the cutterheads.

Referring now to FIGS. 24 and 26, an alternate drive means is provided for each of the cutterhead transmissions where it would be advantageous to permit the cutterheads to strike certain earth formations in a random manner in lieu of the timed progressive sequence as previously described. The motor 138 has a splined shaft connected to the worm shaft 645. The splined connecting shafts facilitate the removal of the motor 138 and the transmission block 132 for repairs. The worm shaft 645 has formed thereon an integral worm 646. The shaft 645 is suitably journaled in bearings supported by the transmission block 132. The worm 646 meshes with and drives the worm gear 647 in turn having its hub keyed to the shaft 648 the latter in turn is suitably journaled in bearings supported by the block 132. The shaft 648 has keyed to one end a bevel gear 649 in turn drives an oil pump (not shown). The opposite end of the shaft 648 has keyed thereto a spur pinion gear 147 (previously shown). The succeeding gear train is identical to the cutterhead drive mechanism previously described for the first embodiment of the earth excavator.

Reciprocatory Conveyor Assembly

The top surface of the cutterheads 2 are provided with cleats 644 to assist in the dislodgement and conveyance of the earth toward the bulldozer blade 606 and subsequent entrance into the conveying system as will be described hereinafter.

Figure 27:
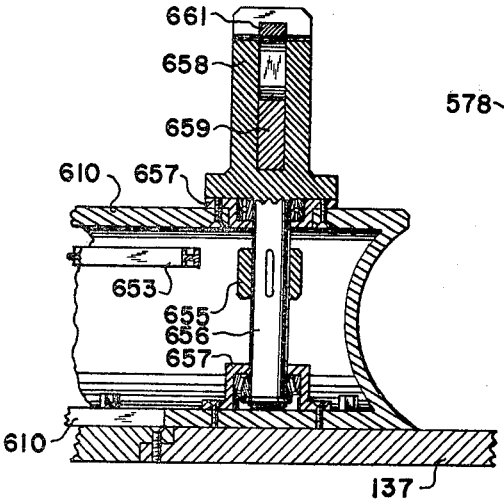
FIG. 27 is an enlarged vertical section taken as indicated along the angled arrows XXVII—XXVII of FIG. 25, illustrating details of the reciprocatory conveying mechanism.
Figure 28:
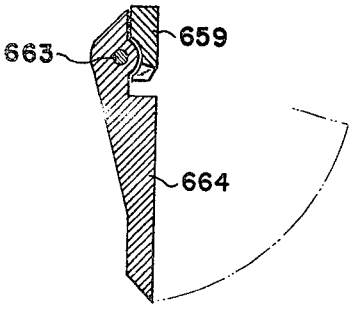
Figure 9:
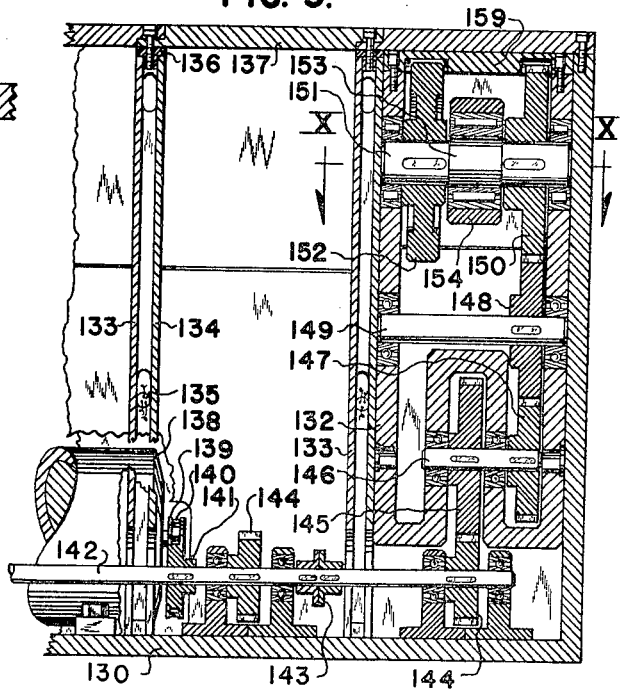
FIG. 9 is a vertical section taken as indicated along the angled arrows IX—IX of FIG. 8, illustrating details of the motor driven line shaft having gears meshing with the independently incased cutterhead gear train. Thus enabling the cutterhead strokes to be individually timed to strike the earth in progression.
Figure 10:
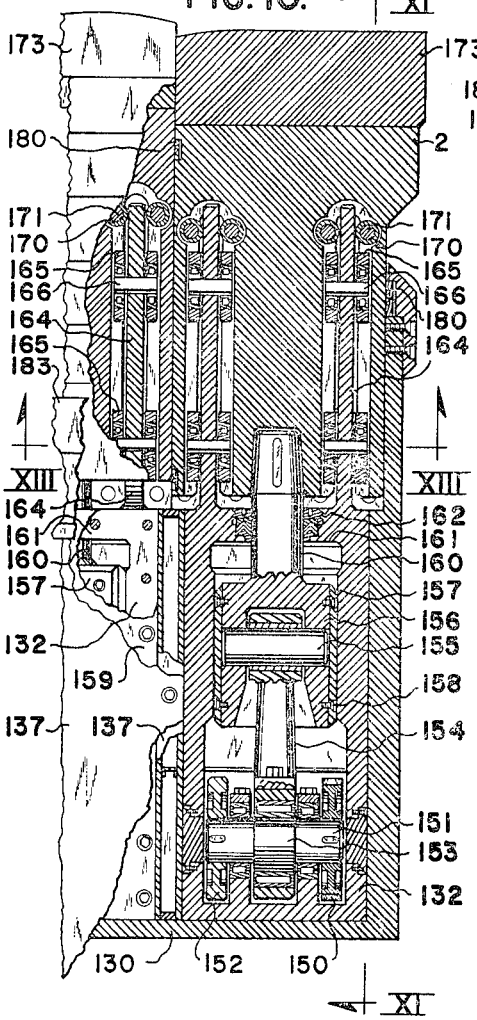
FIG. 10 is a horizontally inclined section taken as indicated along the angled arrows X—X of FIG. 9, illustrating details of the cutterhead driving mechanism.
Figure 13:
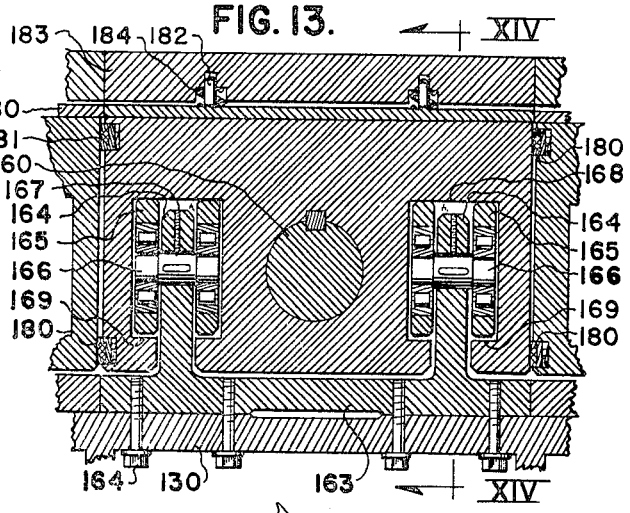
FIG. 13 is an enlarged vertical section taken as indicated along the angled arrows XIII—XIII of FIG. 10 illustrating details of the extended transmission block with integral upright flanges, the vertical thrust rollers, the cutterhead, and the top and side dirt seals.
Figure 11:
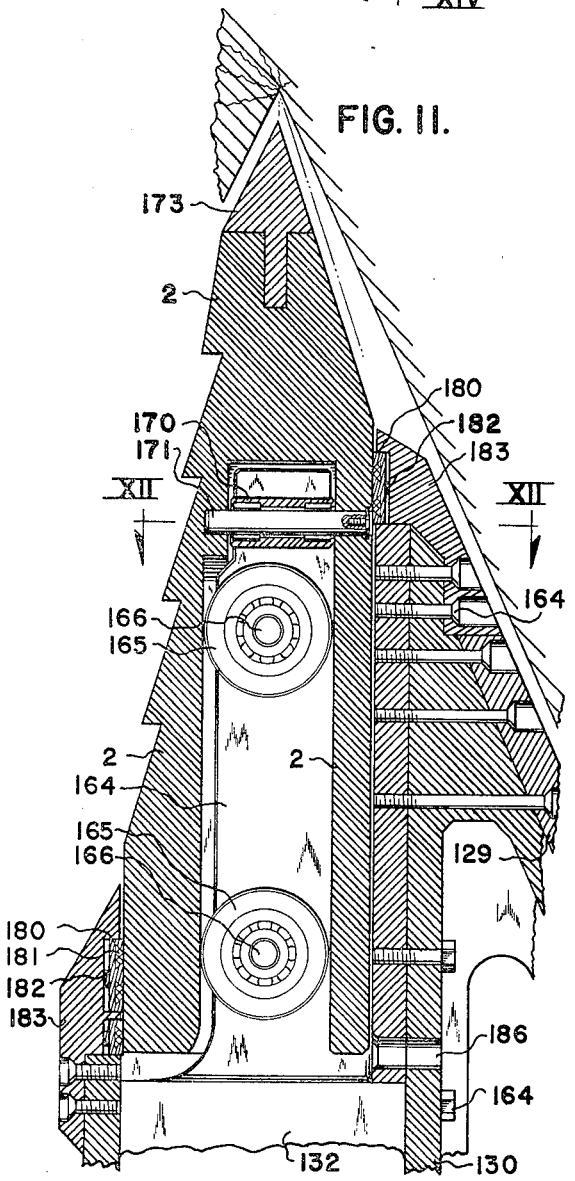
FIG. 11 is a vertical section taken as indicated along the angled arrows IX—IX of FIG. 10, illustrating details of the cutterhead vertical and lateral thrust rollers, and the top and bottom dirt seals.
Figure 25:
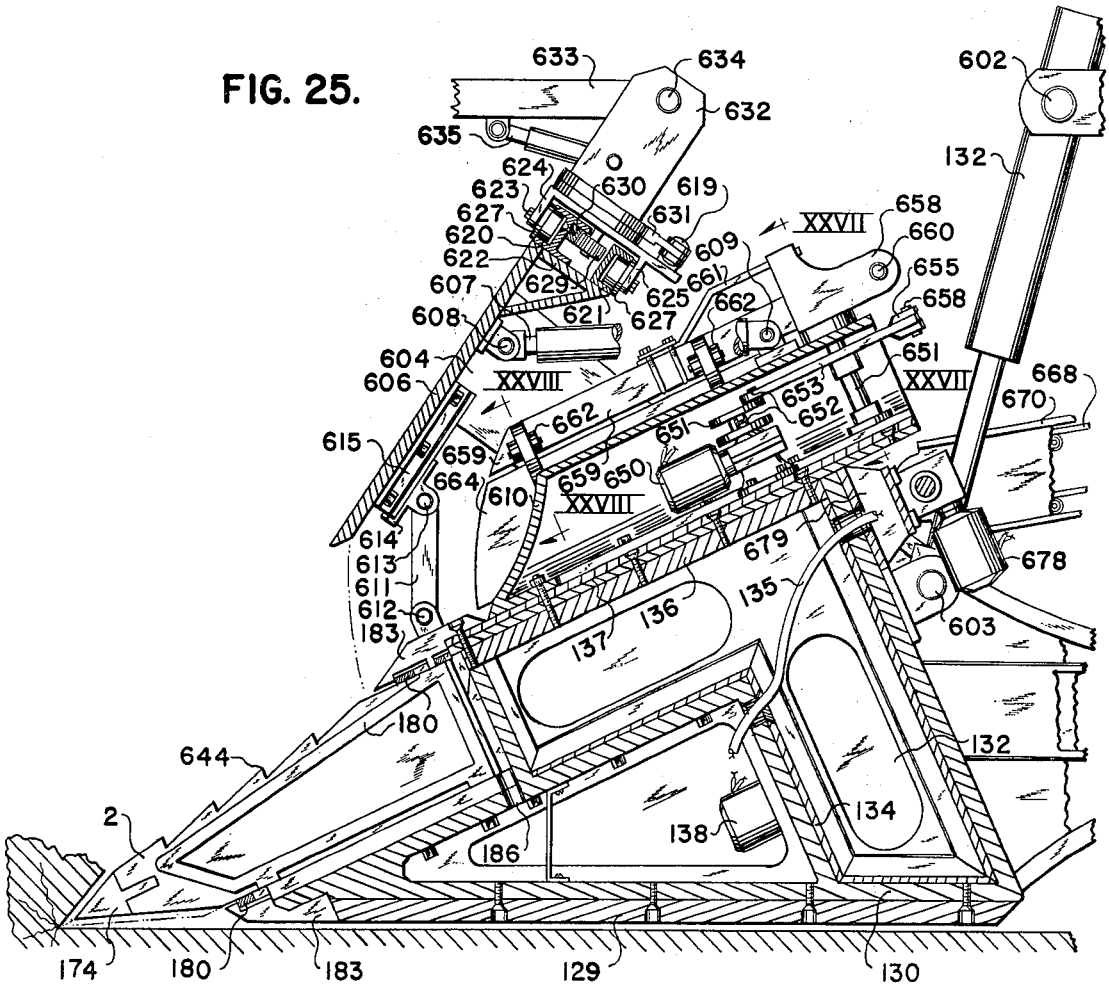
FIG. 25 is an enlarged vertical section taken as indicated along the angled arrows XXV—XXV of FIG. 23, illustrating details of the bulldozer blade with a transversely operable rock ejecting device, the reciprocatory, and endless belt conveying mechanisms, compartmentation of the cutterhead assembly frame, the diversion box, the intercutterhead earth seals and the rock screening means.

Referring to FIGS. 22, 23 and more particularly to FIG. 25, the reciprocatory conveyor comprises a ratiomotor 650 secured to the threshold plates 137. The ratiomotor 650 in turn has keyed to its vertically disposed output shaft a double throw bell crank 651, the latter in turn is provided with two crank pin journals 652 spaced ninety degrees apart in order to position the reciprocatory conveyor blades so that one blade is completing its discharge stroke as the other begins its conveying stroke. A pair of connecting rods 653 are suitably journaled in bearings supported by the crank pin journals 652, the opposite ends of the rods 653 are pivotally connected at 654 to the lever arms 655 in turn having their hubs keyed to the vertical shafts 656 (See also FIG. 27) the latter in turn are suitably journaled in bearings supported by the upper and lower flanged retainers 657, the latter in turn are secured to the diversion box 610 in turn is secured to the threshold plates 137. Integral with and extending above the shafts 656 are turrets 658, the latter are provided with rectangular apertures to receive the reciprocatory conveyor levers 659, the latter in turn are pivotally connected at 660 to the turrets 658. The flat springs 661 are secured to the levers 659 as by "U" bolts. The distal ends of the springs 661 are slidably engaged within the top of the turrets 658. The levers 659 are provided with two pairs of integral brackets 662 in turn are provided with hinge pins 663 (also FIG. 28) in turn hingedly connected to the matching brackets on the shovel plates 664.

The above arrangement permits the shovel plates 664 to swing upwardly on the hinge pins 663 on the forward or gathering stroke in order to override the incoming flow of earth. The rearward or delivery stroke will cause the spring urged shovel plates 664 to dig into the earth flow. In the event that the plates 664 become hung up on a sizeable rock when digging into the earth flow, suitable provisions are made to permit the supporting spring loaded lever arms 659 to raise and return to the horizontal position when clear of the rock. The above arrangement permits the reciprocatory conveyors to alternately convey the incoming earth from the cutterheads across the threshold plates 137 onto a pair of longitudinal endless belt conveyors 667 and 668.

Belt Conveyor Assemblies

The before-mentioned conveyors 667 and 668 are in turn supported by two pairs of channel bars 669 and 670, the latter in turn are pivotally connected to the brackets 671 (FIGS. 22 and 24). The distal ends of the conveyor channel bars 669 and 670 are supported by rollers 672 in turn are supported by the shafts 673 in turn supported by the brackets 674, the latter in turn are secured to the vehicle 1. The above arrangement provides a two fold purpose in that the cutterhead assembly may be raised and lowered thereby permitting the conveyor channel bars 669 and 670 to rotate about their fulcra 680 and to extend or retract on the supporting rollers 672; the other function permits the above channel bars to become raised in the brackets 674 when urged by the hopper rim 302 as the vehicle 1 travels down a steep incline.

A ratiomotor 678 is secured to a raised pedestal 679 (FIG. 25) in turn secured to the frame 130 the latter in turn drives a pair of horizontally disposed shafts 680 (FIG. 23) in turn drives the belt pulleys 681 (FIG. 24) in turn drives the conveyor bolts 668 and 669 (FIG. 23). The transverse conveyors 279 and 280 are identical to those described in the first embodiment of the earth excavator vehicle.

In summary, the dislodged earth is moved up the inclined cutterheads by a joint conveying action of the cutterhead cleats 644 and the force of the advancing excavator vehicle. The earth is further moved by the above means under the bulldozer blade 606 and between the screening bars 611, thence across the seal retainer plates 183, thence onto the threshold plates 137, where the flow of earth is divided by the diversion box 610, thence the reciprocatory conveyors 659, alternately convey the earth across the threshold plates 137, thence onto the longitudinal conveyors 667 and 668, thence cascading onto the transverse conveyors 279 and 280, and thence cascading into the inby hopper 300, thence onto the belt 301 of the telescopic conveyors, as previously described in the first embodiment of the excavation vehicle.

The installation of an identical cutterhead assembly mounted on the opposite end of the above-mentioned vehicle is feasible, thus converting the above vehicle into a dual-ended earth excavator, in a like manner indicated for the following second modification of the dual-ended earth excavator.

Second Modification to the Excavator Vehicle

Figure 29:
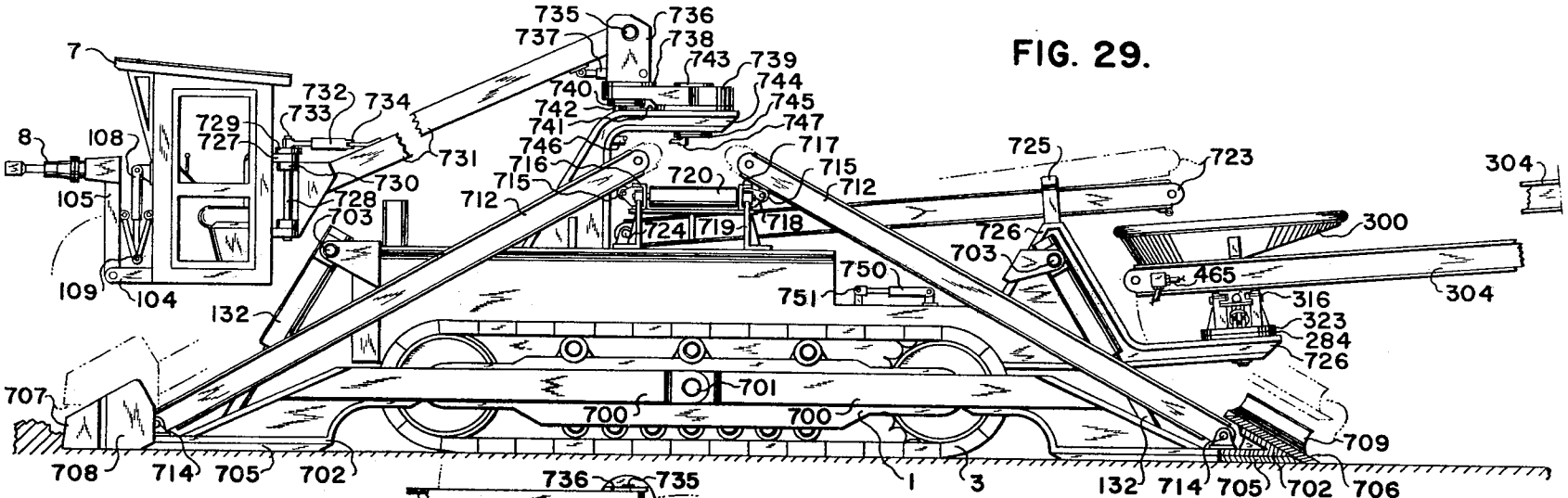
FIG. 29 is a side elevational view of the second modification to the dualistic earth excavator vehicle, illustrating a dualistic scraper means and associated conveying belts, scraper heighth adjussting means and a rotatable operator's cab.
Figure 30:
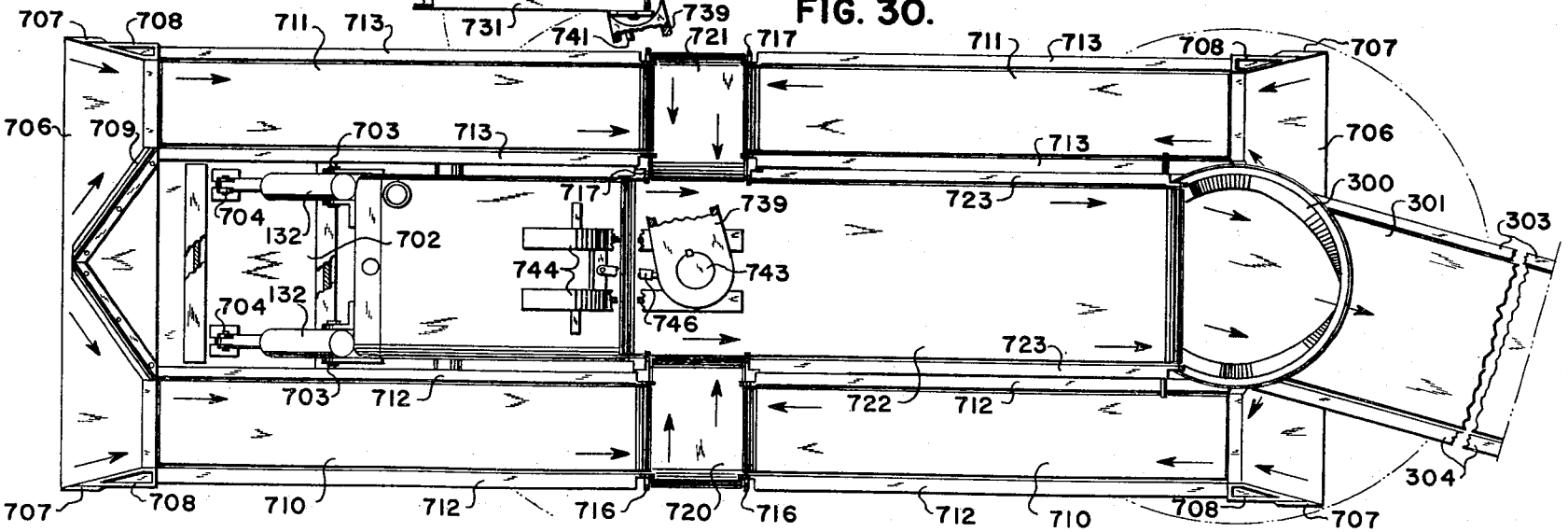
FIG. 30 is a plan view of FIG. 29 illustrating the dual scrapers and the conveying belt arrangement for dualistic earth scrapting operations.

Referring to FIGS. 29 and 30, the second modification to the excavator vehicle with dualistic scraping and conveying means, comprises certain components having their counterparts in the first embodiment of the invention and are identified by the same reference numerals and only those features requiring a change of parts are identified by new reference numerals in the "700" series. The principal change is that the excavation vehicle is provided with a pair of dual-ended scraper scoops, suitable for scraping, dislodging and gathering into the conveying system oil shale, coal and common earth particles. The dual-ended earth scrapers are pivotally connected to the vehicle in turn pivotally support two pair of outboard inclined longitudinal conveyors, in turn are pivotally supported by a pair of transverse conveyors in turn supported by a center positioned longitudinal conveyor, in turn discharges onto the previously mentioned telescopic conveyor vehicles. The above arrangement permits the self-loading and conveying of the earth while traveling in a forward or rearward direction. The scraping, conveying and cab manipulating devices are more compact and simplistic in design than the first embodiment, and are readily attachable to the conventional wheel or crawler driven tractors. The modified excavation vehicle 1 comprises two pair of drawbars 700 pivotally connected at 701 to each side of the tractor 1. The distal ends of the drawbars 700 are secured to the scraper platform 702. A pair of linear actuators 132 are pivotally connected at 703 to the tractor 1, the opposite ends of the actuators 132 are pivotally connected at 704 to the platform 702. The extension or retraction of the actuators 132 will adjust the height of the scraper platform 702 in relation to the ground engaging surfaces of the tractor treads 3. A bottom wearing plate 705 and an inclined scraper wearing plate 706 are secured to the platform 702. A pair of vertical scraper wearing plates 707 are secured to a pair of diversion baffles 708, the latter in turn are secured to the outboard ends of the scraper platform 702. A "V" shaped diversion baffle 709 is secured to the inboard area of the plate 706 in order to divide and direct the flow of earth onto a pair of inclined longitudinal belt conveyors 710 and 711 in turn are supported by two pairs of channel bars 712 and 713 respectively, the latter are pivotally connected at 714 to the platform 702, the distal end of the channel bars 712 and 713 are rotatably borne by the rollers 715, in turn secured to two pair of transverse channel bars 716 and 717 in turn are pivotally secured at 718 to two pair of upstanding brackets 719 in turn secured to the vehicle 1. The above arrangement permits the cutterhead assembly to be raised or lowered in turn permitting the channel bars 712 and 713 to rotate about their respective fulcras 714 and to longitudinally extend or retract on the supporting rollers 715. The channel bars 716 and 717 support a pair of transverse conveyors 720 and 721 respectively, in turn are driven in the same direction toward the longitudinal centerline of the vehicle 1, in turn discharge onto a centrally positioned longitudinal belt conveyor 722 in turn supported by a pair of channel bars 723 the latter in turn are pivotally connected at 724 to the vehicle 1, the distal ends of the channel bars 723 are supported by a pair of brackets 725 in turn supported by the tow bar 726 in turn is secured to the vehicle 1. The tow bar 726 supports the previously mentioned swivel block 284, swivel base 323 and the universal tow bar 316. The foregoing arrangement permits the hopper 300 to urge the conveyor channel bars 723 upward about its fulcra 724 in turn urging the transverse channel bars 716 and 717 about their respective fulcra 718, when the vehicle 1 travels down a steep incline. The earth cascades from the conveyor belt 722 through the hopper 300 thence onto the telescopic conveyor belt 301 for ultimate distribution in an identical manner previously described.

Operator Cab Assembly

The reciprocatory hammer 8 is pivotally connected to the cab 7 and functions in an identical manner previously described in the first embodiment of the excavator vehicle. The cab 7 has a pair of integral brackets 727 in turn are keyed to the vertically disposed shaft 728. A bell crank 729 has its hub keyed to the shaft 728, the latter in turn is suitably journaled in bearings supported by a pair of brackets 730 in turn secured to the distal end of the boom 731. A linear actuator 732 is pivotally connected at 733 to the bell crank 729, the opposite end of the actuator 732 is pivotally connected at 734 to the boom 731. The above arrangement provides the means to rotate the cab 7 about its fulcra 728 in order to improve the operator's visibility and to direct the hammer 8 in the most advantageous position to fracture or eject oversize rocks or remove unwanted debris.

It may be desirable to install rock screening bars on the inclined scraper plates 706, between the outboard and inboard diversion baffles 708 and 709 respectively.

The boom 731 is pivotally connected at 735 to the upstanding brackets 736. A linear actuator 737 is pivotally connected to the boom 731 and the brackets 736. The extension or retraction of the actuator 737 will raise or lower the cab 7. The brackets 736 are secured to a swivel base 738 in turn has an integral downstanding shaft (not shown) pivotally connected to the horizontal channel bar lever 739. A bell crank 740 has its hub keyed to the swivel base shaft 738. A linear actuator 741 is pivotally connected at 742 to the bell crank 740, the opposite end of the actuator 741 is pivotally connected to the channel bar lever 739. The extension or retraction of the actuator 741 will rotate the swivel base 738 and the boom 731 about their respective vertical fulcra 738. The channel bar lever 739 has its hub keyed to the vertically disposed shaft 743 in turn suitably journaled in bearings supported by a pair of upstanding brackets 744 in turn secured to the vehicle 1. A bell crank 745 is keyed to the lower end of the shaft 743. A linear actuator 746 is pivotally connected at 747 to the bell crank 745, the opposite end of the actuator 746 is pivotally connected to the brackets 744. The above arrangement permits the operator to swing his cab to either end of the vehicle for an unobstructed view of each scraper and to place the hammer in position for fracturing or ejecting large sheets of oil shale or other earth fragments too large to enter the conveying system as the vehicle travles in a forward or rearward direction.

The vehicle is remotely controlled from the cab 7, as illustrated by the example of the linear actuator 750 pivotally connected at 751 to the left hand clutch lever and the opposite end of the actuator 750 is pivotally connected to the vehicle 1, a similar actuator is provided for the right hand clutch lever, thereby providing a remote steering means for the vehicle 1 through appropriate electrical control circuits activated from the cab 7.

First Modification to the Distribution Vehicle

Figure 31:
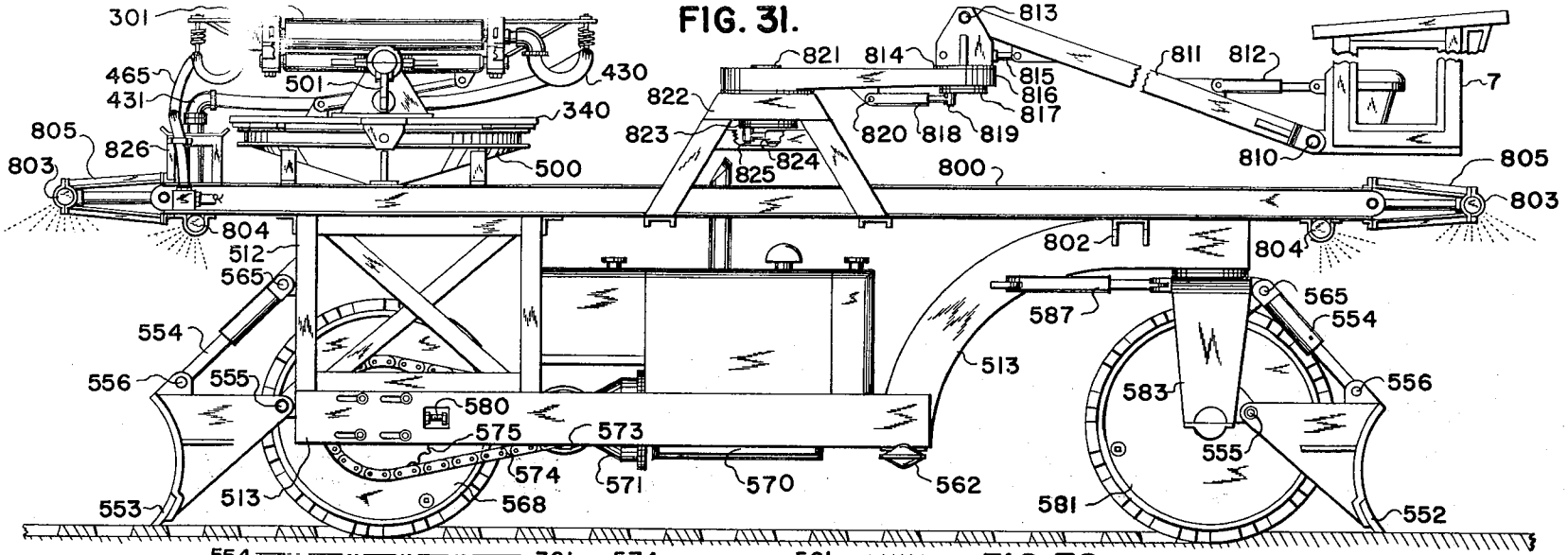
FIG. 31 is a side elevational view of the first modification to the dualistic distribution vehicle, illustrating a single reversible belt conveyor and rotatable operator's cab.
Figure 32:
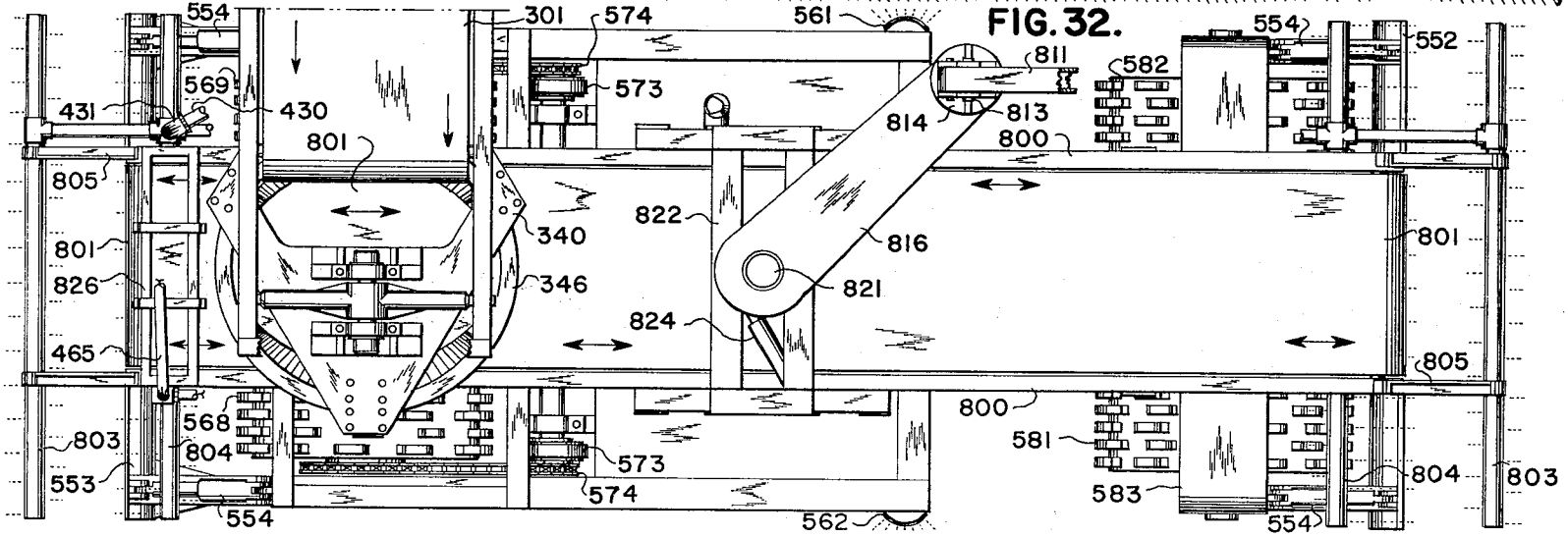
FIG. 32 is a plan view of FIG. 31 illustrating the conveying, sprinkling, spreading and impaction means.

Referring to FIGS. 31 and 32, the first modification to the distribution vehicle with dualistic conveying, spreading, wetting and impacting means, comprises certain components having their counterparts in the first embodiment of the invention and are identified by the same reference numerals and only those features requiring a change of parts are identified by new reference numerals in the "800" series. The principal change is that the dual-faced grader blade assembly has been omitted and the dualistic conveying means has been simplified. In the first modification the earth cascades from the conveyor belt 301 down through the double apertured hopper 500 as previously described in the first embodiment, the hopper 500 is secured to a pair of longitudinally disposed channel bars 800 in turn support a reversible endless conveyor belt 801. The channel bars 800 are supported at one end by the upstanding frame 512 in turn secured to the vehicle frame 513, the opposite end of the channel bars 800 are secured to the channel bar 802 in turn secured to the vehicle frame 513. The earth cascades from either end of the conveyor belt 301 between the two pair of transverse sprinkler pipes 803 and 804, the latter are supported by the brackets 805 secured to each end of the channel bars 800, thence the moistened earth falls in front of the bulldozer blades 552 and 553 for spreading in front of the impactor wheels 568, 569, 581 and 582. The rotational travel direction of the conveyor belt 801 is reversed to coincide with the travel direction of the vehicle 1 thereby providing a continuous flow of earth in front of the appropriate impactor wheels as the vehicle travels in a forward or rearward direction.

The nozzles 561 and 562 are connected to a transverse water pipe in turn secured to the lower portion of the frame 513 to prevent interference with the operator's visibility as the cab is rotated to either end of the vehicle.

A transverse basket frame 826 is secured to the channel bars 800 to support the electrical cable 465 and the water hose 430 above the conveyed earth.

The cab 7 is pivotally connected at 810 to the boom 811. A linear actuator 812 is pivotally connected at one end to the cab 7 and the opposite end of the actuator 812 is pivotally connected to the boom 811. The extension or retraction of the actuator 812 will maintain the cab 7 in a level position regardless of the inclination of the boom 811. The boom 811 is pivotally connected at 813 to the upstanding brackets of the swivel base 814. A linear actuator 815 is pivotally connected at one end to the boom 811 and the opposite end is pivotally connected to the swivel base 814. The extension or retraction of the actuator 815 will raise or lower the boom 811 and the cab 7. The swivel base 814 has an integral downstanding shaft (not shown) suitably journaled in bearings supported by the horizontally disposed channel bar lever 816. A bell crank 817 has its hub keyed to the lower portion of the swivel base shaft 814. A linear actuator 818 has one end pivotally connected at 819 to the bell crank 817, the opposite end of the actuator 818 is pivotally connected at 820 to the lever 816, the latter in turn has its hub keyed to the vertical shaft 821, the latter in turn is suitably journaled in bearings supported by the frame 822 in turn secured to the conveyor channel bars 800. A bell crank 823 has its hub keyed to the shaft 821. A linear actuator 824 has one end pivotally connected at 825 to the bell crank 823 and the opposite end is pivotally connected to the frame 822. The above arrangement provides the means to permit the operator to swing his cab to either end or side of the vehicle to enhance its visibility of the conveying, wetting, spreading and impacting of the earth fill as the vehicle travels in a forward or rearward direction.

Second Modification to the Distribution Vehicle

Figure 33:
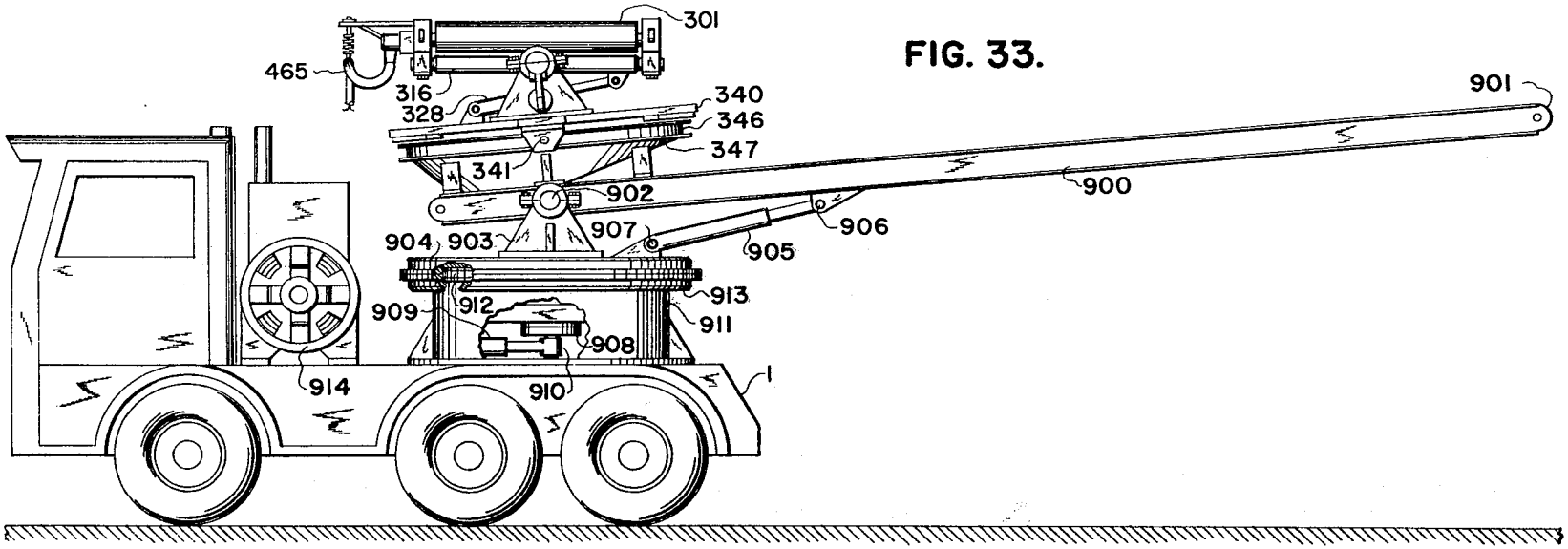
FIG. 33 is a side elevational view of the second modification to the distribution vehicle, illustrating a telescopic conveyor pivotally mounted to the fixed hopper, of the boom conveyor, the latter in turn is pivotally mounted to the vehicle body.
Figure 34:
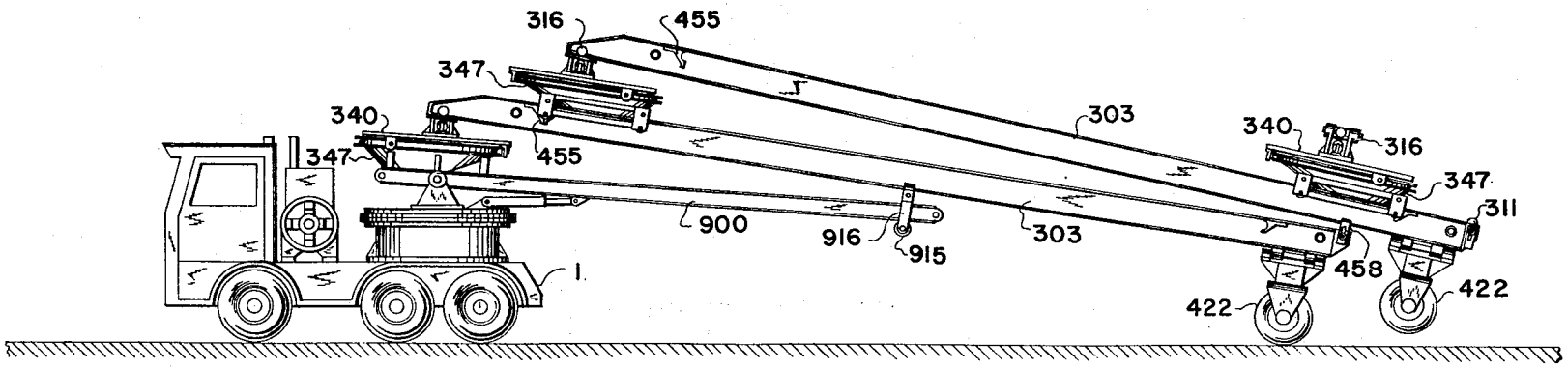
FIG. 34 is a small scale side elevational view of FIG. 33, illustrating the boom conveyor vehicle towing two telescopic conveyors, stacked and locked in position for highway travel.

Referring to FIGS. 33 and 34, the second modification to the distribution vehicle comprises certain components having their counterparts in the first embodiment of the invention and are identified by the same reference numerals and only those features requiring a change of parts are identified by new reference numerals in the "900" series. The principal change is that the boom conveyor vehicle is capable of stockpiling at a mill site or loading the long-haul ore carriers viz., fixed conveyors, trucks, railroad gondola cars, barges and ships, etc. In the second modification the earth cascades from the conveyor belt 301 down through the single apertured hopper 347 as previously described for the telescopic conveyor. The hopper 347 is secured to a pair of longitudinally disposed channel bars 900 in turn support the conveyor belt 901. A pair of trunions 902 are secured to the channel bars 900. The trunions 902 are supported by a pair of upstanding brackets 903 in turn secured to the swivel base 904. A pair of linear actuators 905 are pivotally connected at 906 to the channel bars 900 and the opposite end of the actuator 905 is pivotally connected at 907 to the swivel base 904. The extension and retraction of the actuator 905 will raise or lower the channel bars 900 and the belt 901. The swivel base 904 is keyed to a vertical tubular shaft (not shown) suitably journaled in bearings secured to the turret base 911. The tubular shaft provides a passageway for the power and control cables. A bell crank 908 has its hub keyed to the lower portion of the swivel base shaft 904. A linear actuator 909 is pivotally connected at 910 to the bell crank 908, the opposite end is pivotally connected to the turret base 911, the latter in turn is secured to the vehicle 1. The extension or retraction of the actuator 909 will rotate the boom conveyor about its vertical fulcra. The swivel base 904 is suitably supported by a thrust bearing in turn supported by a bearing flange 912, the latter in turn is secured to the upper rim of the turret base 911. A lower retainer ring 913 is secured to the swivel base 904 in turn bearing upwardly on the lower face of the bearing flange 912. The foregoing arrangement permits maximum maneuverability of the boom conveyor and also permits the vehicle 1 to pass under the telescopic conveyor 301 after unplugging the electric cable 465. A motor generator 914 is secured to the vehicle 1. An alternate location would be to secure the motor generator 914 on a suitable platform in turn secured to the rear end of the channel bars 900 thus providing a more suitable electrical hookup and to counterbalance the weight of the forward end of the loaded conveyor belt 301.

Referring now to FIG. 34, the foregoing vehicle 1 and the boom conveyor 901 are shown in a reduced scale and are arranged for towing one or more telescopic conveyor vehicles on a highway. In order to provide the boom conveyor with the required longitudinal and vertical freedom of movement about their respective fulcra while rigged for towing, by-pass valves are provided (not shown) in the fluid supply and discharge conduits to the actuators 905 and 909 thus providing free fluid communication to each end of the actuator cylinder as the vehicle 1 traverses road curves and undulations. A roller 915 is rotatively borne by a pair of brackets 916 in turn clamped to the channel bars 303 and 304 of the telescopic conveyor to support and permit the extension or retraction of the boom conveyor channel bars 900 as the vehicle 1 and the conveyor wheels 417 and 422 traverse highway undulations.

The telescopic conveyors are shown locked to each other by the forward hopper car stop and clamp device 455 and the side clamps 458. The superimposed free-standing hopper car is secured to the channel bars by a pair of lock screws 460 (See FIG. 18). Any one of the telescopic conveyor vehicles may be utilized as a trailer to transport other conveyor vehicles. The wheelless inby telescopic conveyor section may also be transported in an identical manner previously described for the superimposed conveyor vehicle.

Figure 35:
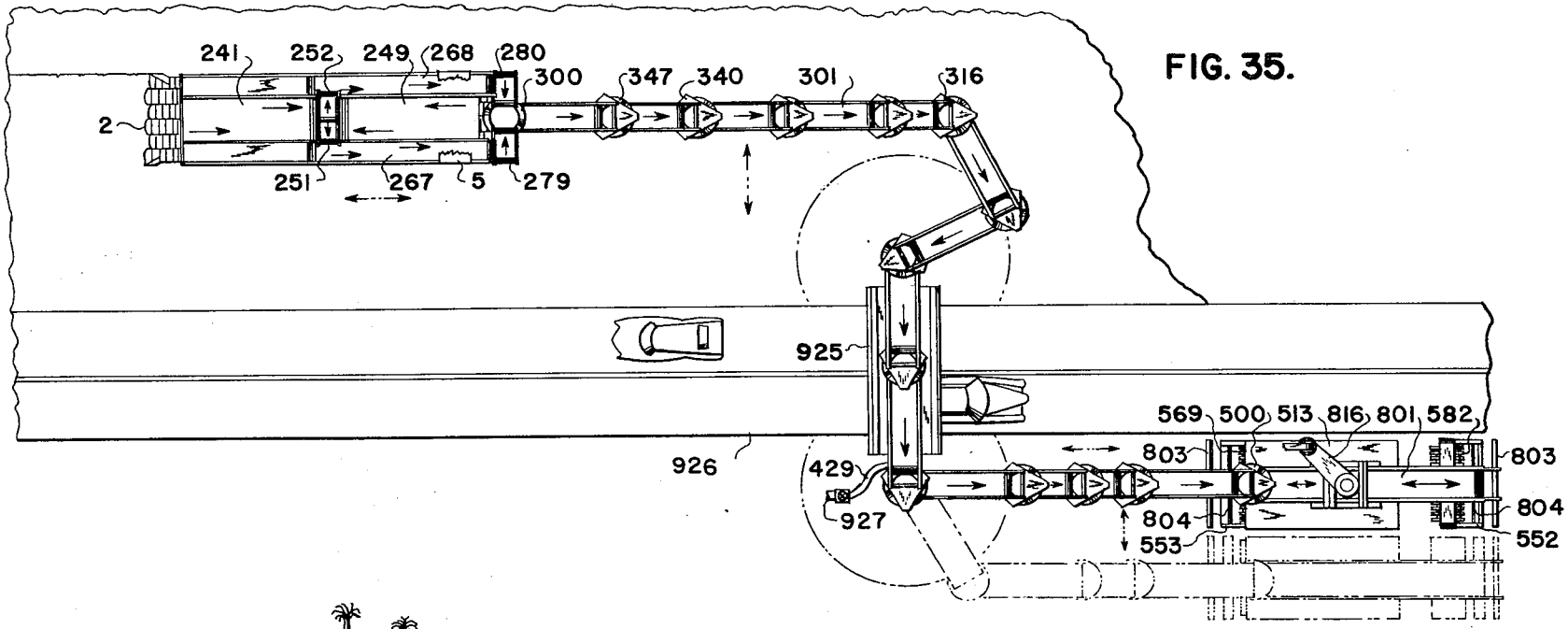
FIG. 35 is a diagrammatic view showing the dualistic earth excavator pivotally connected to a series of telescopic conveyors, the latter in turn are pivotally connected to a dualistic distribution vehicle, thereby excavating, conveying and discharging a continuous flow of earth for a typical highway cut and fill operation while traveling independently in a forward or rearward direction.
Figure 36:
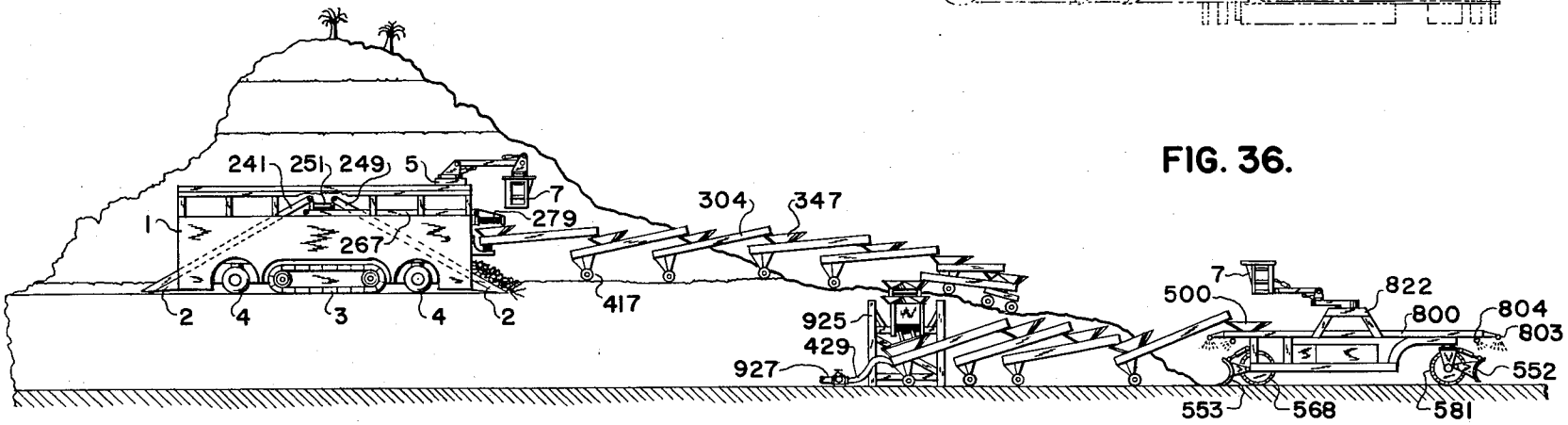
FIG. 36 is a side elevational view of FIG. 35.

Self-Loading Dualistic Earth Excavator With Connecting Telescopic Conveying and Dualistic Distribution Means Referring now to the FIGS. 35 and 36, illustrating the above-mentioned vehicles working on a cut-and-fill operation for highway construction. The excavation vehicle is cutting on one side of the highway while the telescopic conveyor vehicles are conveying the earthfill across a portable highway bridge thence to the distribution vehicle, without interferring with the orderly flow of highway traffic. The excavator vehicle is shown making a cutting pass in a rearward direction by the reciprocatory cutterheads 2 from which the dislodged earth is being conveyed up the longitudinal conveyor 249 thence cascading onto the transverse conveyors 251 and 252, thence cascading onto the longitudinal conveyors 267 and 268 thence cascading onto the transverse conveyors 279 and 280 thence into the hopper 300 and onto the telescopic conveyor belts 301 and across the bridge 925 spanning the highway 926 thence into the hopper 500 of the distribution vehicle, thence onto the reversible conveyor belt 801 for ultimate discharge in front of either of the bulldozer blades 552 or 553 for spreading and ultimate impaction by the impactor wheels 581, 582, 568 and 569 while traveling in a forward or rearward direction. A temporary water main 927 provides the sprinkling water for the earthfill through the flexible water hose 429 thence into the telescopic water conduit means as previously described for ultimate delivery to the sprinkler pipes on the dual-ended distribution vehicle.

The above-mentioned pivotally connected vehicles provide the means to excavate, convey and distribute virtually a continuous flow of earth while simultaneously providing a telescopic electrical and water conduit means, and the flexibility to enable the above-mentioned vehicles to travel oppositely or together, regardless of their everchanging angular and telescopic relationships.

Although three exemplary embodiments and modifications of the invention have been disclosed herein for purposes of illustration, it will be understood that various changes, modifications and substitutions may be incorporated without departing from the spirit of the invention as defined by the claims which follow.

I claim as my invention:

1. In a multi-function distribution vehicle, the combination of:

(a) a telescopic conveyor pivotally mounted to a double apertured hopper;

(b) said hopper being secured to a horizontally disposed reversible conveyor for discharging earth fill on each end of said vehicle while traveling in a forward or rearward direction;

(c) a pair of sprinkling pipes mounted on the ends of said conveyor for wetting the said earth fill;

(d) a pair of sprinkler nozzles secured to said vehicle for wetting the adjacent earth fill areas;

(e) a pair of bulldozer blades mounted to the ends of said vehicle for spreading the earth fill;

(f) a pair of front and rear impactor wheels for supporting said vehicle and impacting the earth fill while travelling in a forward or rearward direction.

2. In a multi-function dualistic earth distribution vehicle, the combination of:

(a) a universal tow bar to receive said distribution vehicle;

(b) a swivel plate roller mounted to a double apertured hopper secured to said distribution vehicle;

(c) a pair of oppositely driven transverse conveyors for dividing the earth flow;

(d) a pivotally mounted and height adjustable double faced grader blade for continuously distributing and grading the earth fill while the said vehicle travels in a forward or rearward direction;

(e) a pair of retractable longitudinally disposed conveyors for discharging the earth from the transverse conveyors on the forward or rearward side of the double faced grader blade while said vehicle travels in a forward or rearward direction;

(f) a pair of water sprinkling pipes for wetting the earth fill as the said vehicle travels in a forward or rearward direction;

(g) a pair of spray nozzles attached to the ends of said sprinkler pipes for wetting the adjacent fill areas;

(h) a pair of rear impactor wheels supporting said vehicle and chain driven through a differential and motor drive means;

(i) a pair of forward impactor wheels secured to a movable fork supporting said vehicle and adapted to be rotated in relation to said vehicle;

(j) a pair of bulldozer blades pivotally mounted on the ends of said vehicle for dispersing earth windrows created by said double faced grader blade;

(k) an operation control cab pivotally mounted to said vehicle permitting the operator an unrestricted view of said vehicle's path and view of both sides of said double faced grader blade while said vehicle travels in a forward or rearward direction; and (l) a load sensing alarm provided to warn the operator of the excavation and distribution vehicles that forward or rearward travel limitations between their respective vehicles and the conveyor vehicles have exceeded the travel limitations.

3. In a self-leveling and self-maneuvering telescopic conveyor vehicle having a universal tow bar, the combination of:

(a) a pair of movable wheel forks mounted in a supporting frame and supporting said conveyor vehicle and adapted to be rotated in relation to said vehicle;

(b) a pair of ground-engaging wheels mounted to the lower ends of said forks;

(c) a first drive means operatively connected to said forks for rotating the same;

(d) a second drive means operatively connected to said forks for driving said wheels;

(e) a steering control means interconnecting said forks for direction orienting the ground-engaging wheels through a range of 180 degrees permitting the vehicle to travel sideward or in any other direction desired;

(f) a drive control means connected to each drive wheel for selectively and reversibly driving each of said drive wheels;

(g) a manual and electric brake means;

(h) a lug connected to one of said rotatable forks and movable therewith;

(i) a pair of switches mounted to operatively engage said lug whereby rotational movement of said movable forks may be limited to 180 degrees;

(j) a third switch mounted half-way between the above switches to operatively engage said lug whereby rotational movement of said movable forks are stopped at mid-range, until moved by an electrical overriding device;

(k) a conveyor frame transversely pivotally mounted at one end to the wheel fork supporting frame, the other end being pivotally mounted to the universal tow bar, said conveyor frame including conveyor stabilizing devices;

(l) a transverse pivotal means controlled by a pair of mercury switches mounted to each end of said conveyor frame for automatically activating the conveyor stabilizing devices as the drive wheels travel over transversely inclined terrain;

(m) said universal tow bar providing a horizontal pivotal means for conveyor telescopic travel, terrain undulations and stacking conveyor for highway travel;

(n) a hopper car roller mounted to the side channel bars of said conveyor frame thereby providing a telescopic means with a connected conveyor vehicle providing super imposed and receiving conveyor vehicles;

(o) a swivel plate pivotally roller mounted to the hopper car to provide a vertical pivotal means permitting angular alignment between the connected conveyor vehicles;

(p) a dirt chute secured to the superimposed conveyor for directing the earth down through an aperture in the swivel plate onto the receiving conveyor vehicle without interruption of flow;

(q) a telescopic electrical conduit means providing continuity between the articulated telescopic conveyor vehicles;

(r) a telescopic water conduit means providing continuity between the articulated telescopic conveyor vehicles and a distribution vehicle;

(s) a continuous flow of earth, electricity and water being provided by the telescopic conveyor vehicles regardless of the angular and telescopic positions assumed between the conveyor vehicles;

(t) a manual local control switch for activating said conveyor vehicle first and second drive means; and (u) a remote control receiver for maneuvering one or more conveyor vehicles by selected frequency modulations transmitted from either of the excavation of distribution vehicles as programmed.

4. In a self-leveling and self-maneuvering telescopic conveyor vehicle having a universal tow bar, the combination of:

(a) a pair of movable wheel forks mounted in a supporting frame and supporting said conveyor vehicle and adapted to be rotated in relation to said vehicle;

(b) a pair of ground-engaging wheels mounted to the lower ends of said forks;

(c) a first drive means operatively connected to said forks for rotating the same;

(d) a second drive means operatively connected to said forks for driving said wheels;

(e) a steering control means interconnecting said forks for direction orienting the ground-engaging wheels through a range of 180 degrees permitting the vehicle to travel sideward or in any other direction desired;

(f) a drive control means connected to each drive wheel for selectively and reversibly driving each of said drive wheels;

(g) a conveyor frame transversely pivotally mounted at one end to the wheel fork supporting frame, the other end being pivotally mounted to the universal tow bar, said conveyor frame including conveyor stabilizing devices;

(h) a transverse pivotal means controlled by a pair of mercury switches mounted to each end of said conveyor frame for automatically activating the conveyor stabilizing devices as the drive wheels travel over transversely inclined terrain;

(i) said universal tow bar providing a horizontal pivotal means for conveyor telescopic travel, terrain undulations and stacking conveyor for highway travel;

(j) a hopper car roller mounted to the side channel bars of said conveyor frame thereby providing a telescopic means with a connected conveyor vehicle providing super imposed and receiving conveyor vehicles;

(k) a swivel plate pivotally roller mounted to the hopper car to provide a vertical pivotal means permitting angular alignment between the connected conveyor vehicles;

(l) a dirt chute secured to the superimposed conveyor for directing the earth down through an aperture in the swivel plate onto the receiving conveyor vehicle without interruption of flow;

(m) a telescopic electrical conduit means providing continuity between the articulated telescopic conveyor vehicles; and (n) a telescopic water conduit means providing continuity between the articulated telescopic conveyor vehicles and a distribution vehicle;

(o) a continuous flow of earth, electricity and water being provided by the telescopic conveyor vehicles regardless of the angular and telescopic positions assumed between the conveyor vehicles.

* * * * *

UNITED STATES PATENT AND TRADEMARK OFFICE

CERTIFICATE OF CORRECTION

PATENT NO. : 4,253,256

DATED : March 3, 1981

INVENTOR(S) : JACK M. FELIZ

It is certified that error appears in the above-identified patent and that said Letters Patent are hereby corrected as shown below:

Column 6, Line 2 - change "IX - IX" to --XI - XI--
Column 7, Line 26 - change "adjussting" to --adjusting--
Column 8, Line 17 - delete "the" and substitute --and--
Column 9, Line 20 - change "meaning" to --meshing--
Column 12, Line 58 - change "136" to --166--
Column 13, Line 35 - change "103" to --183--
Line 59 - change "Fig. 3" to --Fig. 8--
Line 60 - change "scaling" to --sealing--
Column 14, Line 65 - change "N" to --H--
Column 18, Line 46 - change "is" to --in--
Column 21, Line 8 - change "or" to --car--
Line 64 - change "thimrail" to --third rail--
Column 26, Line 36 - change "519" to --513--
Column 27, Line 60 - change "530" to --580--
Column 29, Line 14 - change "leader" to --loader--
Column 31, Line 18 - change "bolts" to --belts--
Column 33, Line 65 - change "301" to --801--
Column 38, Line 39 - change "of" to --or--

Signed and Sealed this

*First* Day of *September 1981*

[SEAL]

*Attest:*

GERALD J. MOSSINGHOFF

*Attesting Officer*

*Commissioner of Patents and Trademarks*